US008218986B2

(12) United States Patent
Makino

(10) Patent No.: US 8,218,986 B2
(45) Date of Patent: Jul. 10, 2012

(54) IMAGE FORMING APPARATUS CAPABLE OF CONTROLLING A MOISTURE CONTENT QUANTITY OF A PAPER

(75) Inventor: Yoji Makino, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 511 days.

(21) Appl. No.: 12/385,742

(22) Filed: Apr. 17, 2009

(65) Prior Publication Data

US 2009/0263149 A1 Oct. 22, 2009

(30) Foreign Application Priority Data

Apr. 18, 2008 (JP) ..... 2008-108691

(51) Int. Cl.
*G03G 15/00* (2006.01)

(52) U.S. Cl. ..... 399/44; 399/66

(58) Field of Classification Search ..... 399/44, 399/66, 314
See application file for complete search history.

(56) References Cited

U.S. PATENT DOCUMENTS

| | | | |
|---|---|---|---|
| 4,401,383 | A | 8/1983 | Suzuki et al. |
| 5,551,283 | A | 9/1996 | Manaka et al. |
| 6,253,041 | B1 | 6/2001 | Tomizawa et al. |
| 6,347,196 | B1 * | 2/2002 | Kawabata et al. |
| 7,239,817 | B2 | 7/2007 | Kaneko et al. |
| 7,376,368 | B2 | 5/2008 | Taira et al. |
| 2006/0201236 | A1 | 9/2006 | Taira et al. |
| 2007/0279447 | A1 | 12/2007 | Kawasaki et al. |

FOREIGN PATENT DOCUMENTS

| | | |
|---|---|---|
| JP | 7-234556 | 9/1995 |
| JP | 9-204080 | 8/1997 |
| JP | 2889909 | 2/1999 |
| JP | 2002-132065 | 5/2002 |
| JP | 3486589 | 10/2003 |
| JP | 2004-54163 | 2/2004 |
| JP | 2004-216883 | 8/2004 |
| JP | 2005-181701 | 7/2005 |
| JP | 2005-249889 | 9/2005 |
| JP | 2005249889 A * | 9/2005 |

(Continued)

OTHER PUBLICATIONS

Extended European Search Report dated Aug. 28, 2009 issued in corresponding Application No. EP 09250857.

(Continued)

*Primary Examiner* — David Gray
*Assistant Examiner* — Laura Roth
(74) *Attorney, Agent, or Firm* — Harness, Dickey & Pierce, P.L.C.

(57) ABSTRACT

The image forming apparatus transfers a toner image onto a print paper via a transfer roller having an electrode configured to apply a bias electric potential upon the print paper. The image forming apparatus includes a humidity detection sensor to detect a humidity of the print paper, a retention electrode to preserve the toner image transferred to the print paper by applying a bias electric potential upon the print paper and a control device configured to control the bias electric potential of each of the electrode of the transfer roller and the retention electrode. The control device measures moisture content quantity of the print paper based on an interval from commencement of variation in the humidity to a maximum quantity of variation of the humidity and controls the bias electric potential of the electrode of the transfer roller and the retention electrode according to the moisture content quantity thus measured.

7 Claims, 17 Drawing Sheets

FOREIGN PATENT DOCUMENTS

| | | |
|---|---|---|
| JP | 2006-209070 | 8/2006 |
| JP | 2006-242710 | 9/2006 |
| JP | 2007-304285 | 11/2007 |
| JP | 2007-322558 | 12/2007 |

OTHER PUBLICATIONS

Office Action dated Feb. 24, 2001 issued in corresponding Chinese Application No. 200910132806.5 and English translation thereof.

Ueda, Masabumi, "Measurements of the Gradient of Water-vapor Pressure and the Diffusion Coefficient," Jpn. J. Appl. Phys. (Oyo Buturi), vol. 25, No. 4(1956), p. 145, The Japan society of Applied Physics (Oyo Buturi Gakkai).

Ueda, Masabumi, "Rate of Evaporation of Water by Forced convention," Jpn. J. Appl. Phys. (Oyo Buturi), vol. 29, No. 7(1960), p. 443, The Japan Society of Applied Physics (Oyo Buturi Gakkai).

* cited by examiner

| MOISTURE CONTENT w OF PRINT PAPER | TRANSFER ROLLER BIAS ELECTRIC POTENTIAL VALUE | RETENTION ROLLER BIAS ELECTRIC POTENTIAL VALUE | RESISTANCE VALUE |
|---|---|---|---|
| w < 4% | a SMALLER | e LARGER | LARGER |
| 4% ≦ w < 6% | b | f | |
| 6% ≦ w < 9% | c | g | |
| w ≧ 9% | d LARGER | h SMALLER | SMALLER |

IMAGE FORMING APPARATUS CAPABLE OF CONTROLLING A MOISTURE CONTENT QUANTITY OF A PAPER

CROSS-REFERENCE TO THE RELATED APPLICATION

The application claims the priority benefit of Japanese Patent Application No. 2008-108691, filed on Apr. 18, 2008, the entire descriptions of which are incorporated herein by reference.

BACKGROUND OF THE INVENTION

1. Field of the Invention

The present invention relates to an image forming apparatus which can prevent an occurrence of a toner image (picture) defect which feigns a white spot or toner scattering by measuring a moisture quantity of a copied print paper to which a toner image is transferred.

2. Description of the Related Art

There is conventionally known an image forming apparatus which employs an electrophotography protocol, such as a copying machine, a printer, a fax machine, or a multifunction device comprising the functions thereof. With the image forming apparatus thus described, a toner image that is formed upon a photosensitive drum by way of an image forming operation is transferred by a transfer device upon a print paper, i.e., a recording paper, whereupon the toner image, which is presently not fixed upon the print paper, is fixed upon the print paper by a fixing device. Thereafter, the print paper whereupon the toner image has been fixed is outputted, i.e., discharged, to a location external to the image forming apparatus.

A moisture quantity, or moisture content quantity (moisture content) of the print paper whereupon the toner image has been transferred, however, varies according to such as a surrounding wherein the image forming apparatus is installed or an internal environment of the apparatus, i.e., such as a temperature or a humidity within the apparatus, and, in order to obtain a high quality image, i.e., a high quality toner image, it is necessary to control an image formation condition, i.e., such as a transfer bias or a fixing temperature, as appropriate to the moisture quantity of the print paper.

The moisture content quantity of the print paper has a particularly significant effect upon the quality of the image, such as, with regard to a transfer portion that transfers the toner image that is formed upon the photosensitive drum upon the print paper, a resistance value of the print paper varies according to a moisture characteristic of the print paper, a change occurs upon the image that is transferred upon the print paper as a consequence of a decline in a toner proportion, i.e., a transfer efficiency, of the transfer by the transfer portion, and a stable, reliable image quality becomes impossible to obtain as a result.

As an instance of the circumstance thus described, a color printer is a key current trend with the image forming apparatus. The color printer creates a rich color image by transferring, in a series of overlays, a plurality of toner images, each toner image comprising a different color. A transfer method known as an interim transfer protocol is known as the transfer method of the color image thus formed. The interim transfer protocol transfer method involves initially performing a multiple overlay transfer, i.e., a primary transfer, of the plurality of toner images, each toner image comprising a different color, upon a transfer body other than the print paper, and thereafter, transferring the color toner image thus formed upon the print paper in a single coordinated transfer, i.e., a secondary transfer.

The interim transfer protocol transfer method is frequently used, owing to the fact that it involves performing the transfer of the color toner image to the print paper in a single coordinated step, thereby conferring an advantage such as requiring few restriction conditions on a layout of the conveyance of the print paper, thus allowing a miniaturization of the apparatus as a whole. Conversely, however, given that the toner image thus formed from the overlay of the plurality of toner images, each toner image comprising a different color, is transferred to the print paper in the single coordinated step by a given transfer bias electric potential value, a risk arises of an image defect occurring, depending upon the moisture characteristic, i.e., the resistance value, of the print paper, such as a toner image, within the toner image thus formed from the overlay of the plurality of toner images, each toner image comprising a different color, that is furthest removed from the print paper, not being transferred to the print paper. It is therefore crucial that the transfer bias electric potential be controlled according to a moisture content state of the print paper.

As a representative instance of such an image defect, consider developing a poor quality image, wherein an image that is painted over a given region, which is referred to as a solid image, is transferred to the print paper such that the toner scatters upon a boundary region of the image. The phenomenon that thus occurs is referred to as a toner scattering or a solid area scattering. In addition, another instance of developing a poor quality image involves the toner, which is assumed to be painted over an entirety of the solid image, as per the preceding circumstance, being not fully transferred to the print paper, giving rise to a break in the image thus transferred, similar to when an insect eats a hole through a leaf. The circumstance thus described is referred to as a white streak or a white spot.

A likelihood of the two types of image defect described herein arising increases when the moisture content quantity of the print paper is low, or, put another way, when the resistance value of the print paper is high, an electric charge that is conferred by the transfer bias electric potential is held upon the print paper, and the image defect thus described occurs as a result of such as either a decline in a transfer efficiency that arises, in turn, from a weakening of an electrical field strength, or an abnormal electrical discharge that arises, in turn, when a voltage that is conferred during a period of high resistance, i.e., when the transfer bias electric potential is extremely large, is itself too strong. Modifying the transfer bias electric potential corrects the situation.

A trade-off exists between the two types of image defect described herein, however, such as is depicted in FIG. 26, wherein controlling the transfer bias electric potential in an attempt to correct for one type of image defect causes the other type of image defect to become more prominent.

In other words, setting the transfer bias electric potential so as to correct for one type of image defect causes the other type of image defect to gradually become more prominent, and the reverse is also true, i.e., setting the transfer bias electric potential to correct for the second type of image defect causes the first type of image defect to gradually become more prominent instead. As a consequence, it is difficult to keep both types of image forming malfunctions under control. A bias electric potential is thus conventionally set to an intermediate portion, wherein neither image defect occurs to a significant degree, as a baseline value. Accordingly, the moisture content state of the print paper is changed, in turn causing a level of the image quality characteristic to decline, such as is depicted in FIG. 27, leading thereby to a state wherein the white spot or the toner scattering occurs.

As a method of controlling and correcting for the image defects described herein, a plurality of image forming apparatuses have been proposed over time, comprising a detection unit that is correlated with the moisture content characteristic of the print paper, wherein the moisture content characteristic of the print paper is specified based on a result of the detection by the detection unit, and a control of the image formation condition is performed in accordance with the moisture content of the print paper.

As an instance thereof, an image forming apparatus that performs the control of the image formation condition in accordance with information that relates to the moisture content of the print paper, and the unit that detects the moisture content of the print paper, is known as per the following:

Japanese Patent Application Laid Open No. 2006-209070 discloses a primary transfer unit that transfers a toner image, which is formed and charged upon a photosensitive body, upon an interim transfer body, a secondary transfer unit, further including a contact transfer body, which sandwiches the print paper against a transfer surface, whereupon the toner image is transferred upon the interim transfer body, and conveys the print paper being further sandwiched between the contact transfer body and the interim transfer body, and an electrode, which is located upon an interior of the interim transfer body, and which impresses a voltage upon the print paper that is sandwiched between the interim transfer body and the contact transfer body, wherein the electrode is employed so as to impress, upon the toner image, by way of a constant current control, a voltage comprising a polarity that is identical to a polarity of the charge that the toner image comprises, and which transfers the toner image from the interim transfer body to the print paper, and a temperature and humidity sensor, which detects an environment surrounding the image forming apparatus, wherein, when the temperature and humidity sensor detects either a low temperature or a low humidity, a correction for a deterioration in an image characteristic is effected thereupon by lowering a size of a transfer current.

Japanese Patent Application Laid Open No. 2005-181701 discloses an image forming apparatus comprising a developing unit that forms the toner image upon an image forming body, and a transfer unit that impresses a bias voltage, thereby transferring the toner image that is formed upon the image forming body to a transfer material, wherein is installed an absolute humidity detection unit that detects an absolute humidity, and, in response to a result of the detection by the absolute humidity detection unit, effects to correct for the deterioration of the image characteristic by shifting the transfer unit in a parallel direction to a direction of a conveyance of the transfer material.

Japanese Patent Application Laid Open No. 2007-304285 discloses using an air duct to remove an atmosphere from a close proximity to an obverse surface of a recording medium while the recording medium is in transit upon a conveyance path, positioning a sensor unit portion upon an atmospheric exhaust port, whereupon the atmosphere thus removed is directed, and positioning a thermal conductivity protocol humidity sensor, which is formed by employing an MEMS technology, upon the atmospheric exhaust port, wherein a humidity of the atmosphere thus directed is detected, and a control unit estimates a moisture content quantity of an obverse surface layer of the recording medium in accordance with an output of the humidity sensor, and sets an image forming process control condition according to the moisture content quantity thus estimated.

Japanese Patent Application Laid Open No. 2007-322558 discloses a moisture content quantity estimation device, including a first detection unit that detects a first information relating to a moisture content quantity of a sheet material, either making contact with the sheet material, or in a location close to the sheet material, and further including the steps of detecting the first information relating to the moisture content of the sheet material, detecting a second information relating to a factor that affects the information relating to the moisture content of the sheet material, calculating a predictive estimate of a moisture content quantity of the sheet material in accordance with the first information and the second information, and adjusting an image forming process control condition in accordance with the moisture content quantity estimate thus computed, wherein a thermal conductivity protocol humidity sensor, which is formed by an MEMS technology, is employed as the first detection unit.

Japanese Patent Application Laid Open No. H9-204080 discloses a configuration wherein a heat roller is installed upon a fixing portion of an image forming apparatus, whereupon a thermal fixing control is performed, as well as upon a portion of a print paper conveyance portion where upon the print paper traverses, wherein the heat roller is employed to heat the print paper, a water vapor that arises as a result of the heat thus imparted to the print paper is detected by a humidity sensor, and an achievement of a positive image quality characteristic is effected by changing a control condition of each respective process of an image formation, i.e., transfer and fixing, in accordance with information that is detected by the humidity sensor.

Japanese Patent No. 3,486,589 discloses a configuration including a charging unit that charges, by way of an image forming unit that electrostatically forms the toner image upon a transfer material, a surface of the transfer material whereupon the toner image is formed, prior to the toner image being formed upon the transfer material, so as to be charged with a polarity that is opposite to a regular charge polarity of the toner, a control unit that controls a voltage that is impressed upon the charging unit in accordance with a length in a direction that is effectively orthogonal to the direction of the conveyance of the transfer material, and a humidity detection unit, wherein an achievement of a high quality color image characteristic is effected by the voltage that is impressed upon the charging unit being controlled by the control unit, in accordance with a result of a detection by the humidity detection unit.

Japanese Patent Application Laid Open No. 2006-242710 discloses a configuration including a moisture content quantity detection sensor and a control unit, wherein a CPU of the control unit determines a temperature by consulting a temperature table, in accordance with a frequency data that is acquired from the moisture content quantity detection sensor in a state wherein the print paper is not present within an electrostatic capacity region of the conveyance path, determines a moisture content quantity that is contained within the print paper by consulting a moisture content quantity table, in accordance with the frequency data that is acquired from the moisture content quantity detection sensor in the state wherein the print paper is not present within the electrostatic capacity region of the conveyance path, a frequency data that is acquired from the moisture content quantity detection sensor in a state wherein the print paper is present within the electrostatic capacity region of the conveyance path, and the temperature that has been previously determined, and provides a feedback of a degree or quantity of control for a control of an image formation in accordance with a result of the determination thus performed.

Japanese Patent Application Laid Open No. 2004-54163 discloses a configuration wherein an obverse surface of the print paper, i.e., the transfer material, is brought into contact with a pair of conductive rollers, whereupon a voltage has been impressed, a specific resistance of the obverse surface of the print paper is detected, the specific resistance of the obverse surface of the print paper thus detected is converted into the moisture content quantity of the print paper, and an achievement of a correction of an image quality characteristic is effected by applying a moisture to the print paper, when the moisture content quantity of the print paper is less than a standard value.

Japanese Patent Application Laid Open No. 2004-216883 discloses a configuration including a conductive material, as a detection unit, wherein a specific electrical resistance of the conductive material varies according to a moisture content quantity of a print paper, either when the print paper traverses the conductive material or the print paper comes into contact with the conductive material, a value that is detected by way of the change in the specific electrical resistance resulting there from is compared with an information that is stored within a memory portion that is installed into the apparatus, and an ambient humidity computed thereupon, wherein an external force is applied to the print paper, a characteristic of the print paper, such as a thickness or a hardness of the print paper, is simultaneously acquired thereby, and an image formation condition with respect to the print paper to be printed upon is controlled in accordance with the information thus acquired.

Japanese Patent Application Laid Open No. H7-234556 discloses a configuration including a control unit, which projects a light upon the print paper, derives a proportion of moisture content of the print paper according to a change in a wavelength of the light that is reflected from the print paper, and corrects each respective image formation condition thereby.

Japanese Patent Application Laid Open No. 2005-249889 discloses a configuration wherein a unit is installed that derives a moisture content quantity from a resistance value that arises when the voltage is impressed upon both surfaces of a transfer material, varies a condition of contact between the transfer material and the image forming body, as well as the transfer bias electric potential, according to the moisture content quantity thus derived, and maintains a favorable severance characteristic for separating the transfer material from the image forming body.

In addition, a detailed research paper regarding a water vapor distribution is also known; refer to the cited non-patent references 1 and 2 hereinafter for details.

The cited non-patent reference 1 depicts an existence of a region, known as a diffusion layer, wherein, when the moisture content evaporates, a movement of the moisture content, i.e., the water vapor, is performed in a linear fashion from a location whereat the evaporation of the moisture content commences.

In addition, the cited non-patent reference 2 denotes that a steady movement of the water vapor in a constant quantity is possible for water, when the water is at a surface level, as an instance thereof, and it is possible for a thickness of the diffusion layer, when not affected by such as a wind acting thereupon, to be present within a region ranging from surface level to a height on the order of 10 mm in a perpendicular direction, and for the thickness of the diffusion layer to comprise a height of 2 mm to 3 mm or thereabouts without difficulty even if the wind does exert an effect thereupon.

With the print paper, however, the moisture content quantity that is contained by the print paper varies depending on an ambient environment whereupon the print paper is present. Thus, the water vapor movement thereupon is not steady, nor is the quantity of the water vapor constant, such that, when dealing with a very small quantity of moisture, the region of the thickness of the diffusion layer becomes smaller still, and it is necessary to detect the water vapor that is arising from the print paper at an infinitely close distance from the obverse surface of the print paper, in order to accurately detect the water vapor thus arising therefrom.

Cited Non-Patent Reference 1:

Ueda, Masabumi: "Measurements of the Gradient of Water-vapour Pressure and the Diffusion Coefficient," Jpn. J. Appl. Phys. (OYO BUTURI), Vol. 25, No. 4(1956), p. 145, The Japan Society of Applied Physics (OYO BUTURI GAKKAI)

Cited Non-Patent Reference 2:

Ueda, Masabumi: "Rate of Evaporation of Water by Forced Convection," Jpn. J. Appl. Phys. (OYO BUTURI), Vol. 29, No. 7(1960), p. 443, The Japan Society of Applied Physics (OYO BUTURI GAKKAI) 1960.

Whereas the disclosure according to Japanese Patent Application Laid Open No. 2006-209070 shows a configuration whereby the temperature and humidity sensor detects the environmental humidity whereupon either the transfer device or the image forming apparatus is installed, and controls the electrical current value of the electrode that is installed upon the transfer portion, it is the moisture characteristic of the print paper that is significantly related to the image quality characteristic, and thus, a degree of irrationality arises in detecting the environmental temperature and humidity wherein the apparatus or the device is located, and treating the temperature and humidity thus detected as the moisture characteristic of the print paper.

As an instance thereof, when the environment wherein the apparatus or the device is located is a high humidity environment, and the print paper is left in the environment thus constituted for an extended period of time, the print paper will eventually contain a significant amount of moisture. If the apparatus or the device is operated in such a state, the environment wherein the apparatus or the device is located will be in a state that is similar to the state of the print paper, and thus, the printing operation will be performed without impairing the image quality characteristic.

If the humidity in the ambient environment should be dramatically lowered, however, owing to such as air conditioning, the moisture that is contained within the print paper will not rapidly evaporate. As a consequence, the print paper will remain in the state of containing the significant amount of moisture for an indeterminate period of time. The print paper that is stacked upon such as a cartridge for loading the print paper upon the apparatus or the device will be particularly slow to adapt to a change in the environment, and the state of the print paper thus stacked will be clearly inappropriate as a result.

If the printing operation is performed in such a state, the environment of the apparatus or the device will have changed to a low humidity environment, and thus, the apparatus or the device will perform the control of the image formation in accordance with the low humidity environmental condition setting. The print paper that is actually conveyed upon the apparatus or the device, however, is still in the high humidity state, thus giving rise to the image formation defect or a defect in the conveyance of the print paper.

If only one sheet of print paper is contained within the print paper cartridge, a significant proportion of the obverse surface of the print paper will come into contact with the ambient environment, such that the print paper will more easily adapt to the ambient environment, and the print paper will accordingly dry out more rapidly. If dozens of sheets of the print paper are stacked within the print paper cartridge within the image forming apparatus, however, a smaller proportion of the obverse surface of each respective sheet of the material of the print paper will instead come into contact with the ambient environment, such that each respective sheet of the material of the print paper will dry out much less readily as a result.

Accordingly, when it is determined that the state of the moisture content of each respective sheet of the print paper is identical to the environment wherein the apparatus or the device is located, and the determination thereof is taken into account in the electrical current value control information, the actual state of the moisture content actually differs from the state thus determined, and it will be apparent therefrom that a malformation will arise with the image formation thereupon.

Whereas the disclosure according to Japanese Patent Application Laid Open No. 2005-181701 shifts the transfer unit, treating the result that is detected by the absolute humidity detection unit as the moisture characteristic of the transfer material, i.e., the print paper, the transfer material, i.e., the print paper, has a moisture characteristic that is dependent upon a relative humidity, and thus, as an instance thereof, if a print paper with the same moisture characteristic is detected with a different environmental temperature, the value of the relative humidity will vary, as will the trend of the variance of the value of the relative humidity.

As a consequence, even if the result of the detection by the absolute humidity detection unit is employed to control the transfer unit, the value of the relative humidity varies according to the temperature, interfering with the control being made that is appropriate to the ambient humidity, and thus preventing obtaining a desirable image.

Whereas the disclosure according to Japanese Patent Application Laid Open No. 2007-304285 has a configuration wherein the atmosphere that is removed from the obverse surface of the sheet of the material of the print paper by the air duct is directed, and the humidity of the atmosphere thus directed is detected, it is believed that the atmosphere that is removed from the obverse surface of the sheet of the material of the print paper by the air duct will be directed efficiently only when a sheet of the material of the print paper is conveyed that maintains a higher state of moisture content than the humidity of the environment wherein the units are installed.

When the sheet of the material of the print paper either discharges or adsorbs moisture according to an equilibrium between the sheet of the material of the print paper and the ambient environment, and the sheet of the material of the print paper is conveyed that comprises a lower moisture content state than the ambient environment, the atmosphere will not flow within the duct. In addition, even if the atmosphere within the duct should be adsorbed within the sheet of the material of the print paper, a shape of an aperture portion of the duct will comprise a shape that impedes a reverse flow of the atmosphere with respect to the sheet of the material of the print paper. It is thus believed that the sheet of the material of the print paper that is being conveyed will traverse the air duct before the atmosphere may be directed to the sheet of the material of the print paper that is being conveyed, and it is further believed that a problem such as a delay in the detection of the humidity of the atmosphere thus directed will result from the phenomena described herein, giving rise to a malfunction wherein it will be possible to detect only the moisture state of the print paper that comprises a specified moisture characteristic.

The disclosure according to Japanese Patent Application Laid Open No. 2007-322558 comprises a configuration wherein the moisture content of the sheet of the material of the print paper, whereupon the image process operation is performed, is estimated in accordance with the value that is detected by the first detection unit, which detects, in the location that is in close proximity to the sheet of the material of the print paper, the humidity thereof, and the information that is detected by a second detection unit, which is installed within a periphery of the conveyance path within the apparatus. In other words, the second detection unit measures the environment of the periphery of the conveyance path, or, put another way, the environment within the apparatus, and estimates the moisture content quantity of the print paper, which is believed to vary according to the effect of the environment being thus measured.

A distribution of the temperature and humidity is inevitably present, however, within the ambient temperature and humidity of the environment within the apparatus or the periphery of the conveyance path. As an instance thereof, installing the detection unit upon the periphery of the conveyance path, within a proximity to the fixing device, which is configured to perform the thermal fixing, resulting in a comparatively high temperature environment. Conversely, installing the detection unit upon the periphery of the conveyance path, close to a print paper supply portion whereupon is stored the sheet of the material of the print paper, results in a comparatively low temperature environment. Furthermore, it is believed that the environment of the transfer portion that transfers the toner material to the sheet of the material of the print paper will vary from the environment of the other locations described herein. In addition, even when an ongoing series of printing operations is performed, the environment of each respective image formation process portion changes with each successive print in the series, according to a quantity of the prints that is performed in the series and the time required for the print series.

The estimated value of the moisture content of the sheet of the material of the print paper thus varies significantly depending upon the location whereupon the detection unit is installed. Thus, performing the control of each respective image process according to the moisture content value thus estimated cannot be considered to be desirable, and it would be necessary to install a third, fourth, and fifth detection unit for each respective image process, i.e., such as developing, transfer, and fixing, in order to employ the method described herein to solve the problems described herein. Presuming such a configuration, however, causes an increase in a quantity of components, and inevitably raises costs, making the configuration described herein unsuitable for practical application.

In addition, even presuming a configuration wherein the first detection unit is moved around and performs the task of both the first and the second detection units, it is possible, depending on a distance to be traveled by the first detection unit, that no noticeable difference may be found in the detected value in the proximity to the sheet of the material of the print paper and the detected value elsewhere within the apparatus. Avoiding such a problem by extending the distance to be traveled will require increasing a time required for such a travel, resulting in a malfunction wherein it would not be possible to support a high speed printing environment (to be described hereinafter). In addition, it would be possible that the environment prior to the movement of the detection unit would itself be moved around to the location of the environment subsequent to the movement of the detection unit, by the movement of the detection unit thereupon.

In addition, anticipating a disruption of the detected value by a flow of the atmosphere that arises when the detection unit is moved, and attempting to move the detection unit slowly in order to prevent such a problem from occurring, gives rise to a malfunction with a image forming apparatus manufactured in recent years whereupon the high speed printing is being advanced, wherein the detection fails to keep pace with the speed of the conveyance of the print paper.

The problems thus described become more prominent the higher the sensitivity and responsiveness of the sensor become, such as with the thermal conductivity protocol humidity sensor, which is formed by employing the MEMS technology, and thus, it is believed that the technologies described herein would not be suitable for practical application.

When the print paper is heated as per the disclosure according to Japanese Patent Application Laid Open No. H9-204080, the water vapor content that arises therefrom varies according to the moisture content quantity that is contained by the print paper. As an instance thereof, a large quantity of the water vapor is generated when the print paper that comprises a significant moisture content is heated. When the water vapor arises particularly with respect to such as the fixing portion, which performs the thermal fixing process, it is anticipated that the water vapor condenses into droplets that adhere upon the periphery of the apparatus, resulting in a dew formation state thereupon.

A risk exists that the droplets that have adhered within the apparatus may remain thereupon, causing the image defect, the defect in the conveyance, or moreover, a defect in the apparatus proper. Such as an exhaust feature is thus necessary to specifically remove the droplets therefrom. In addition, the print paper comprises the moisture content or moisture content proportion that is optimal when forming the image, i.e., 4% to 6% or thereabouts, and thus, when heat controlling the print paper during the conveyance prior to forming the image, the moisture content proportion varies thereupon, such that a risk exists that the moisture content proportion of the print paper may decline, in turn causing a deterioration in the image quality thereby.

Whereas the disclosure according to Japanese Patent Application Laid Open No. H9-204080 includes performing the partial heating of the print paper and ascertaining the quantity of the water vapor that arises as a result, the quantity of the water vapor that arises thereby will be minute when the moisture content quantity that is contained by the print paper is itself very small. In such a circumstance, the water vapor that arises thereby will easily adapt to the ambient environment, making it impossible to identify a difference between the water vapor and the ambient environmental conditions, in turn complicating the accurate control of the print paper thereupon.

The disclosure according to Japanese Patent No. 3,486,589 comprises the temperature and humidity sensor being positioned upon an upper portion of the print paper cartridge, wherein the print paper is stacked for storage, with the temperature and humidity sensor computing the moisture content quantity of the print paper from the absolute moisture quantity that is detected thereby upon a periphery of the upper portion of the print paper cartridge. The ambient environment of the loading cartridge whereupon the print paper is stacked is measured therewith. As an instance thereof, if the moisture content state varies between the print paper that comprises the upper portion of the stack, the print paper that comprises a middle portion of the stack, and the print paper that comprises a lower portion of the stack, a circumstance of a state wherein the various moisture content states are mixed and offset one another will be detected as a result, allowing the control condition to be determined according to the ambient environment whereupon a bundle of the print paper and the apparatus are located, without regard for the moisture content quantity of a single sheet of the print paper. Thus, the image formation defect of the defect in the conveyance thereof may arise, owing to the fact that the control condition will not match if the print paper with the moisture characteristic that differs from the moisture characteristic that was detected by the process described herein is used in the image formation instead.

The disclosure according to Japanese Patent Application Laid Open No. 2006-242710 includes placing a coil portion, in a state wherein a high frequency voltage is impressed thereupon, of the moisture content quantity detection sensor in opposition to a metallic or other conductor, giving rise to an electrostatic conjunction between the coil portion of the moisture content quantity detection sensor and the conductor, wherein the frequency of the high frequency voltage that is impressed upon the coil portion fluctuates according to the distance between the coil portion and the conductor. In order to employ the principle thus depicted, the moisture content quantity detection sensor is positioned so as to sandwich the conveyance path whereupon the print paper is conveyed, as well as in opposition to, and at a given distance from, the coil portion and a metallic print paper conveyance guide, such that, when the print paper traverses the electrostatic capacity region that is formed between the coil portion of the moisture content quantity detection sensor and the print paper conveyance guide that is in opposition to the coil portion of the moisture content quantity detection sensor, a dielectric constant of the electrostatic capacity region increases as a result of the print paper traversing therethrough, thereby causing an oscillation frequency of an oscillator circuit of the moisture content quantity detection sensor to change. The moisture content quantity of the print paper is thus determined in accordance with a quantity of the variation of the oscillation frequency thus detected. It is inevitably necessary, however, for the metallic conductor to be located in opposition to the coil portion in such a circumstance. Consequently, the print paper conveyance guide must also inevitably be metallic in nature, and, in addition to becoming a constraining condition for a design of the apparatus, it is necessary for the coil portion and the conductor portion to be installed as close to parallel to one another as possible. A risk is present that an accurate detection of the value of the moisture content may not be possible if the coil portion and the conductor portion differ from the parallel by so much as less than one degree, demanding a high degree of precision in component assembly during the process of the manufacture of the image forming apparatus, which in turn increases such as a number of the manufacturing processes thereupon, none of which is desirable in terms of price-performance.

In addition, the result of the detection varies according to the ambient temperature, and thus, while the determination of the moisture content is performed according to a data of the moisture content quantity table, the detection varies according to distance, and the accurate detection thereof would become impossible if a location for the installation of the moisture content quantity detection sensor or the conveyance guide should be distorted, thereby changing the distance therebetween. Furthermore, if such materials as dust, arising from such as bits of paper, or droplets formed by condensation, adhere to the conveyance guide, the electrostatic capacity will be altered, leading to a decline in a reliability of the detection of the moisture content quantity thereupon.

Whereas the disclosure according to Japanese Patent Application Laid Open No. 2004-54163 comprises a basic configuration of the steps of impressing the voltage upon the obverse surface of the print paper, measuring the resistance value between one or more terminals subsequent to the impression of the voltage, and converting the result of the measurement into the moisture content of the print paper, in order to derive the resistance value of the obverse surface and the reverse surface of the print paper and convert the resistance values thus derived into the moisture content of the print paper, it is not possible to perform a stable measurement if the voltage that is impressed upon the print paper is a low voltage. Thus, a high voltage on the order of hundreds of volts is impressed upon the print paper, necessitating a charging time in order to obtain the high voltage required. A malfunction thus occurs in that, when a plurality of sheets of the print paper is conveyed at high speed, such as when performing a series of print jobs all at once, the measurement of the resistance value of the print paper will not keep up with the speed at which the print paper is being conveyed.

In addition, the resistance value of the print paper is unstable immediately subsequent to the impression of the voltage upon the print paper, and thus, it would be desirable to measure the resistance value of the print paper on the order of one minute subsequent to the impression of the voltage upon the print paper. A certain amount of time would also be necessary in order to accurately measure the resistance value of the print paper, and thus, a malfunction arises wherein the measurement of the resistance value of the print paper will not keep up with a series of print jobs being performed all at once. Furthermore, the specific resistance of the print paper varies according to the effect of the ambient temperature and the ambient humidity of the environment whereupon the measurement is performed, and thus, a risk is present of not being able to detect the moisture content quantity of the print paper in an accurate and stable manner.

In addition, recent types of print paper that are employed with the image forming apparatus have either been coated with a chemical upon the obverse surface thereof, or had a special obverse surface process performed thereupon, in order to increase the quality of the image that is formed thereupon. When bringing the print paper that has thus been treated into contact with the pair of conductive rollers whereupon the voltage has been impressed, and detecting the specific resistance of the obverse surface of the print paper, it is difficult to accurately detect the specific resistance of the obverse surface of the print paper under conventional circumstances, thus precluding the accurate detection of the moisture content quantity of the print paper. Moreover, an error in the detection of a change in the resistance runs a risk of erroneously conferring the moisture upon such as the specially treated paper, thereby restricting the print paper that is employed upon the image forming apparatus.

In addition, acquiring the information of the characteristic of the print paper requires a transformation portion that transforms the value that is detected by the detection portion into the characteristic of the print paper, a memory portion for storing the information of the print paper that is to be used for distinguishing the type of the print paper, and a discrimination portion that compares the information that is stored in the memory portion. Accordingly, a configuration aside from the detection portion will be required, further complicating the configuration of the apparatus.

A configuration that applies the external force in order to obtain the information of the thickness or the hardness of the print paper is also complicated, and will require a dedicated space in order to be installed within the image forming apparatus.

When leaving a plurality of sheets of print paper that comprise the same moisture content respectively in environments of different temperature and humidity, the quantity of variation of the ambient humidity in close proximity to the print paper differs therebetween, and a malfunction arises wherein the moisture content quantity that is contained within the print paper cannot be determined solely by detecting the ambient temperature and humidity.

While the configuration described herein acquires the data by comparing the value that is detected by the detection portion with the data that is stored upon the memory portion, even when considering only a single type of the print paper, storing all of the relationships between the moisture content quantity and the temperature and humidity would require a tremendous amount of data capacity, and a problem occurs in that a consideration of the cost-benefit ratio leads to a conclusion that the configuration described herein is lacking in practical application.

Even if the print paper comprises the same moisture content quantity, in a state wherein the configuration comes into contact with the atmosphere that is in close proximity to the print paper and the print paper, the effect of the temperature and humidity of the space wherein the atmosphere that is in close proximity to the print paper and the print paper differs, and thus, a risk is present that the information of the detection of the moisture content of the material of the sheet of printing paper will change.

It is conceivable that it would not be possible to distinguish the characteristic of the print paper without applying an impact to the print paper by way of the external force thereupon, as well as that a fiber composition of the obverse surface of the print paper will be altered by the application of the external force thereto, thereby running a risk of a problem occurring with the image quality.

The disclosure according to Japanese Patent Application Laid Open No. H7-234556 presumes a configuration comprising, at an absolute minimum, a signal processing portion that controls an optical signal, a light emission portion that emits the optical signal, a light reception portion that receives the optical signal, and a calculation processing portion that determines the moisture content of the print paper from the optical signal thus received, wherein the light emission portion and the light reception portion must be respectively installed upon a site whereupon the print paper traverses, and in a location wherein the light emission portion and the light reception portion sandwich the print paper, in opposition to one another. In the present circumstance wherein the demand is for miniaturization and cost reduction of the image forming apparatus, the configuration as described herein leads to an increase in the number of components and thus an increased cost, as well as requiring creating two spaces in order to install the light emission portion and the light reception portion in the location such that the light emission portion and the light reception portion sandwich the print paper, in opposition to one another, which may result in a factor that interferes with the miniaturization of the image forming apparatus.

In addition, a risk occurs wherein the detection operation may become unstable, owing to a possibility that an unforeseen refraction or reflection of the light may occur as a result of a change in the ambient environment, i.e., the temperature, the humidity, or the wind, or such as a change in the distance or the region of the detection, arising from the droplet or the bits of paper adhering to either the light emission portion or the light reception portion.

Furthermore, a risk arises wherein, if such as the droplet adheres to the light emission element or the light reception element, by way of such as the condensation thereupon, it will not be possible to emit or receive the light in the normal state, and thus, it will not be possible to make an accurate detection thereby. In addition, the light emission intensity of an LED light source that is frequently used as the light emission element is characterized by weakening in an inverse proportion to a total light emission time. As the light emission intensity weakens over time, the light that is reflected from a material to be measured becomes fainter, an output from the light reception element becomes unstable, and a precision of the detection thereby deteriorates as a result.

The disclosure according to Japanese Patent Application Laid Open No. 2005-249889 comprises a configuration wherein the print paper moisture content detection unit further comprises a configuration that is approximately identical to the configuration disclosed according to Japanese Patent Application Laid Open No. 2004-216883, and a width of a nip of the transfer portion and the transfer bias electric potential is controlled according to the result of the detection of the moisture content of the print paper. A malfunction arises, however, wherein the accurate control of the transfer portion in accordance with the state of the moisture content of the print paper is complicated as a result.

Moreover, when the plurality of the print paper traverses the print paper conveyance path in a series, such as in a circumstance wherein the print paper is supplied and printed in a series, i.e., an image formation in a series, the environment within the image forming apparatus varies according to the moisture content quantity of the print paper. As an instance thereof, when printing in series upon a series of sheets of print paper with a high moisture content, the interior of the image forming apparatus will be changed into a state of high humidity. As a result, the condensation may occur upon the fixing device, which thermally fixes the image upon the print paper, or a filming phenomenon may occur upon such as the developing device, wherein a discharge generation material, which adheres to the obverse surface of the photosensitive drum, adsorbs the moisture content, which may in turn cause the image quality defect.

SUMMARY OF THE INVENTION

Accordingly, an object of the present invention is to provide an image forming apparatus that is capable, even during such as a printing in a series, of performing a rapid detection of a moisture content quantity on a per sheet of print paper basis while the print paper is being conveyed, accurately and in a stable manner, with a simple configuration, that is capable of controlling a transfer of an image upon the print paper according to the result of the detection of the moisture content quantity, and moreover, that is capable of avoiding an occurrence of an image defect within a transferred image, known as a white streak, i.e., a white spot, or a toner scattering, by employing a method of measuring the moisture content quantity of the print paper that is capable of being applied to an application aside from the detection of the moisture content quantity of the print paper.

In order to accomplish the object, an image forming apparatus according to an embodiment of the present invention transfers, upon the print paper, a toner image, which is formed upon an image forming body by way of an image forming operation, wherein the print paper is conveyed toward a fixing device via a transfer roller, including a belt shaped transfer material and an electrode for impressing a bias electric potential upon the print paper.

The image forming apparatus includes a humidity detection sensor, which is installed in a location that is in a close proximity to, and in an opposition to, an obverse surface of the print paper, a retention electrode that is installed further downstream from the transfer roller in a direction of a conveyance of the print paper, and further upstream from the fixing device in the direction of the conveyance of the print paper, which impresses a bias electric potential upon a surface of the print paper that is opposite to a surface of the print paper that makes contact with the transfer roller, thereby preserving the toner image that is transferred upon the print paper, and a control device that measures a moisture content quantity of the print paper, based upon a time that is required from a commencement of a variation in a humidity detection that is obtained by a humidity detection of the humidity detection sensor until a quantity of the variation thereof reaches a maximum, and controls each respective bias electric potential according to the moisture content quantity thus measured.

BRIEF DESCRIPTION OF THE DRAWINGS

FIG. 16 is a diagram depicting an installation structure of a humidity detection sensor according to the second embodiment of the present invention, wherein

FIG. 21 is a diagram depicting an installation structure of a humidity detection sensor according to a third embodiment of the present invention, wherein

FIG. 22 is a diagram depicting an installation structure of a humidity detection sensor according to a fourth embodiment of the present invention, wherein

DETAILED DESCRIPTION OF THE PREFERRED EMBODIMENTS

Embodiments of the present invention will be described in detail hereinafter, with reference to the attached drawings.

First Embodiment

Figure 1:
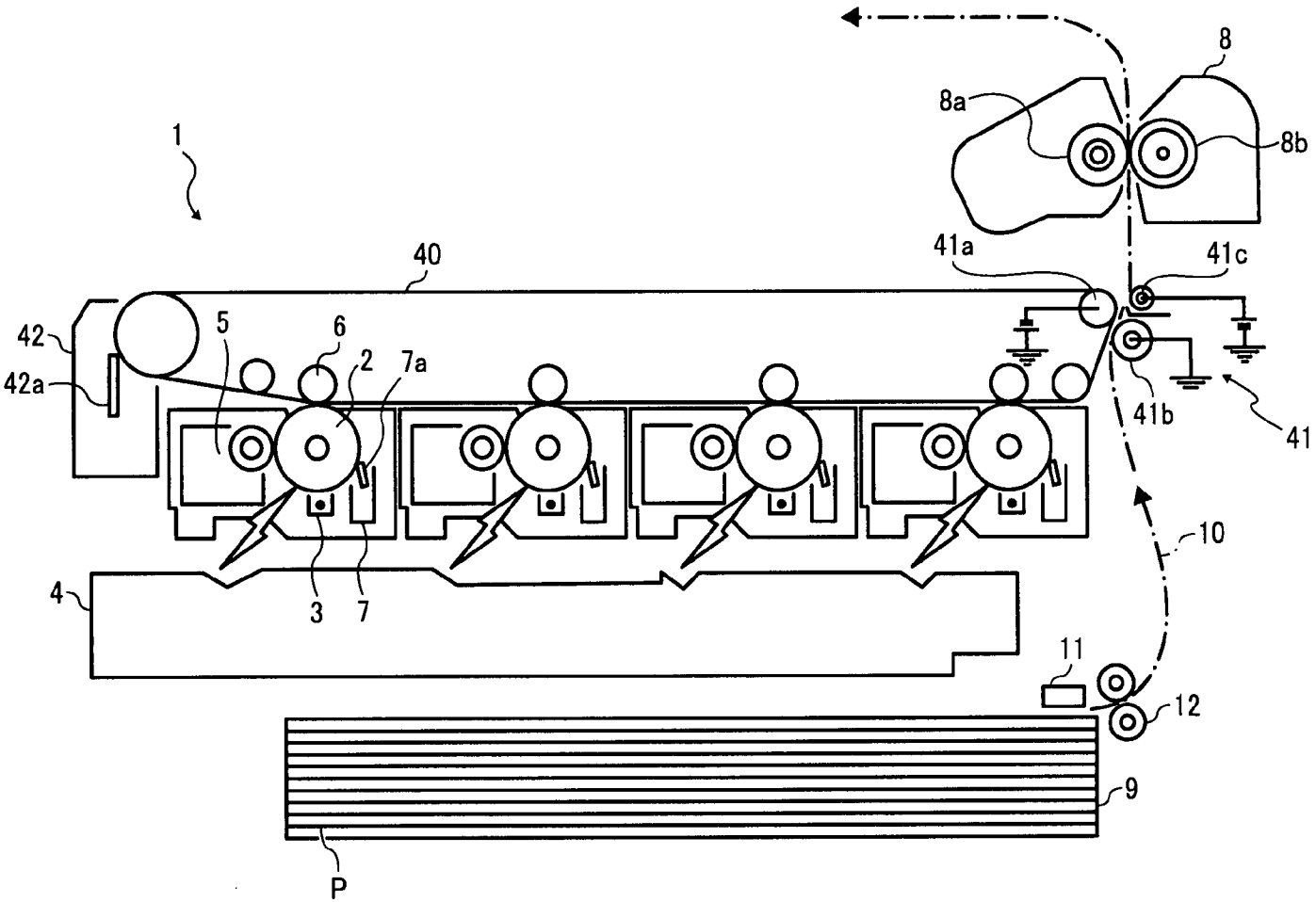
FIG. 1 is a conceptual configuration diagram depicting an image forming apparatus according to a first embodiment of the present invention.

FIG. 1 is a conceptual configuration diagram depicting an image forming apparatus that performs a color printing according to a first embodiment of the present invention, such as an electrophotography protocol copying machine, which comprises a secondary transfer mechanism.

In FIG. 1, reference numeral 1 denotes an image forming apparatus. A charging device 3, an image writing device, i.e., an exposure device, 4, a developing device 5, a primary transfer device 6, and a cleaning device 7 are positioned on a per color basis upon a periphery of a photosensitive drum 2 as an image forming body within the image forming apparatus 1. In the present circumstance, the devices described herein are positioned thereupon on a C, Y, M, and K per color basis. It is to be understood that reference numeral 7*a* is a cleaning blade.

A transfer belt 40 in an infinite loop shape is positioned as a transfer material within the image forming apparatus 1, so as to make contact with the photosensitive drum 2. A cleaning device 42 is positioned upon a downstream side of a direction of a movement of the transfer belt 40, and a secondary transfer device 41 is positioned upon an upstream side of the direction of the movement of the transfer belt 40. A fixing device 8 is positioned upon an upper portion of the secondary transfer device 41. It is to be understood that reference numeral 42*a* is a cleaning blade.

The fixing device 8 is primarily configured of a fixing roller 8*a* and a pressure roller 8*b*. The secondary transfer device 41 is primarily configured of a transfer roller 41*a* and 41*b*, and a retention roller 41*c*.

A print paper P is loaded in a stack into a print paper feed cartridge 9, and the print paper P is outputted via a pair of resist rollers 12, a print paper supply conveyance path 10, the secondary transfer device 41, and the fixing device 8. A humidity detection sensor 11 is located in a close proximity to the pair of resist rollers 12, and in a close proximity to an upper portion of the print paper feed cartridge 9.

According to the image forming apparatus 1, an obverse surface of the photosensitive drum 2, which is rotationally driven at a prescribed process speed, is uniformly charged by the charging device 3. Thereafter, an exposure is performed by the image writing device 4 according to an image information of a source document that is read in by a reading in device (not shown), and an electrostatic latent image is formed upon the photosensitive drum 2. Thereafter, a developing is performed by a toner, i.e., a developing solution, of the developing device 5, and a toner image is formed for each respective color upon the photosensitive drum 2. The toner image that is formed in a plurality of colors upon the photosensitive drum 2 is transferred in a series of overlays, by the primary transfer device 6, upon the transfer belt 40, which is rotationally driven at a prescribed process speed.

Conversely, the print paper P is conveyed to the secondary transfer device 41 from the print paper feed cartridge 9, traversing the print paper conveyance path 10 at a prescribed timing, and the toner image that is formed upon the transfer belt 40 is transferred upon the print paper P in the series of overlays by the secondary transfer device 41. The print paper P whereupon the toner image is thus transferred is conveyed toward the fixing device 8 upon the downstream side of the direction of the conveyance of the print paper P, whereupon the toner image is fixed upon the print paper P by being heated and pressurized between the fixing roller 8*a* and the pressure roller 8*b*. The print paper P whereupon the toner image is fixed is thereafter discharged externally from the image forming apparatus 1 by a discharge roller (not shown).

It is to be understood that the toner image that remains upon the obverse surface of the photosensitive drum 2 without being transferred upon the transfer belt 40 is removed by the cleaning blade 7*a* of the cleaning device 7, and the obverse surface of the photosensitive drum 2 is offered thereafter for generating a subsequent image. In addition, the toner image that remains upon the transfer belt 40 without being transferred to the print paper P is removed by the cleaning blade 42*a* of the cleaning device 42, and the obverse surface of the transfer belt 40 is offered thereafter for generating a subsequent image.

The humidity detection sensor 11 detects a humidity, i.e., a moisture vapor, of the print paper P that is supplied from the print paper feed cartridge 9.

Figure 2:
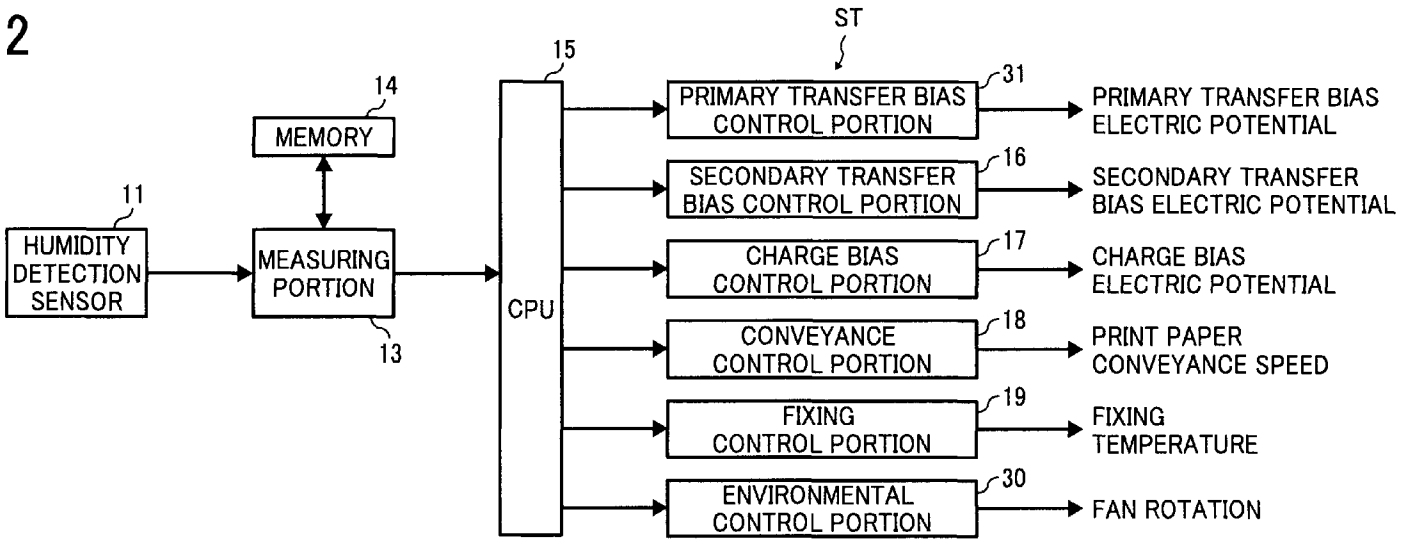
FIG. 2 is a block diagram depicting a control device of the image forming apparatus according to the first embodiment of the present invention.

The image forming apparatus 1 comprises a control device ST, such as is depicted in FIG. 2. The control device ST is primarily configured of a measuring portion 13, a memory 14, a CPU 15, a primary transfer bias control portion 31, a secondary transfer bias control portion 16, a charge bias control portion 17, a conveyance control portion 18, a fixing control portion 19, and an environmental control portion 30. An output of the detection by the humidity detection sensor 11 is inputted into the measuring portion 13, the measuring portion 13 performs a loading and unloading of information between the measuring portion 13 and the memory 14, and a result of the operation thereupon is outputted toward the CPU 15. The CPU 15 both operates as a control unit that controls an overall operation of the image forming apparatus 1, as well as controlling, in accordance with the information that is inputted to the CPU 15 from the controlling measuring portion 13, the first transfer bias control portion 31, the secondary transfer bias control portion 16, the charge bias control portion 17, the conveyance control portion 18, the fixing control portion 19, and the environmental control portion 30.

The primary transfer bias control portion 31 controls a primary transfer bias electric potential, the secondary transfer bias control portion 16 controls a secondary transfer bias electric potential, the charge bias control portion 17 controls a charge bias electric potential, the conveyance control portion 18 controls a speed of a conveyance of the print paper P, the fixing control portion 19 controls a fixing temperature, and the environmental control portion 30 controls a rate of rotation of a fan.

Figure 11:
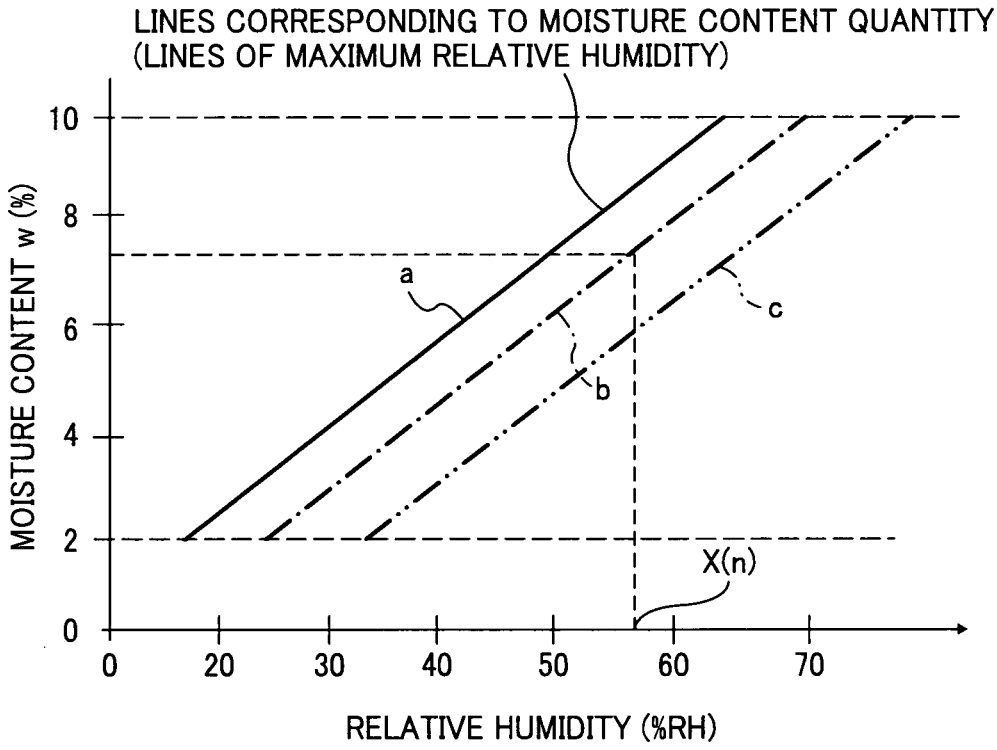
FIG. 11 depicts a relationship between a relative humidity in a proximity to the print paper and the moisture content quantity of the print paper.

A data that denotes a relationship between an environmental humidity value and a moisture content quantity w, i.e., a moisture content quantity of the print paper P, is preloaded into the memory 14; refer to FIG. 11 for particulars. The measuring portion 13 either measures or computes the moisture content quantity of the print paper P that is supplied from the print paper feed cartridge 9, in accordance with the output of the detection that is outputted from the humidity detection sensor 11 and the data that is preloaded into the memory 14.

In the present circumstance, the CPU 15 performs a control of the secondary transfer bias control portion 16, in accordance with the information of the moisture content quantity of the print paper P that is outputted from the measuring portion 13. Furthermore, the CPU 15 controls the environmental control portion 30, and controls a fan motor that causes the fan (not shown) that is installed within the apparatus to rotate, in accordance with the environmental humidity value that is outputted from the measuring portion 13. A detailed description of the control of the environmental control portion 30 and of the fan motor by the CPU 15 will be provided hereinafter.

Figure 3:
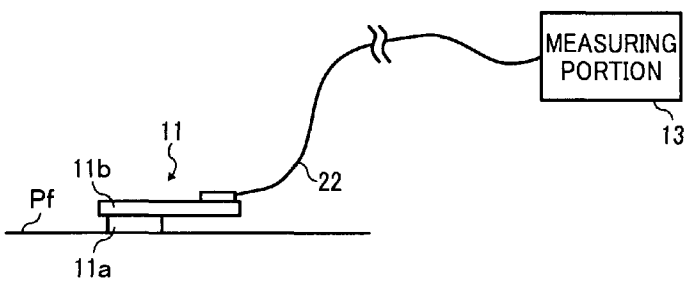
FIG. 3 depicts a humidity detection sensor according to the first embodiment of the present invention.

The humidity detection sensor 11 comprises a sensor portion 11*a*, which detects the humidity, i.e., the moisture vapor, of the print paper P, and a substrate 11*b*, which is electrically connected to the sensor portion 11*a*, such as is depicted in FIG. 3. The substrate 11*b* is electrically connected to the measuring portion 13 by way of a signal line 22.

A thermal conductivity type humidity sensor, which is formed by applying an MEMS technology, is used as the sensor portion 11*a* of the humidity detection sensor 11. It would be possible to anchor the sensor portion 11*a* upon the substrate 11*b*, and while the substrate 11*b* may comprise any type of material that is capable of extracting an electrical signal from the sensor portion 11*a*, it is generally desirable to employ such as an electrical circuit board that is engineered by employing such as a glass epoxy material. The sensor portion 11*a* is bonded to the substrate 11*b*, being attached to the substrate 11*b* by a microscopic metallic wire (not shown), and electrically connected to the measuring portion 13 by the signal line 22.

The sensor portion 11*a* is positioned upon the print paper feed cartridge 9, in a state so as to protrude so as to be in a maximally close proximity to the obverse surface of the print paper P. A flow of a movement of the moisture from the print paper P thus reaches the sensor portion 11*a* as quickly as possible, and the movement of the moisture that occurs between the print paper P and the ambient environment may be detected in a favorable manner without incurring interference from another configuration component or material of the humidity detection sensor, the substrate 11*b* representing an instance of a component that may potentially interfere with the detection of the movement of the moisture therebetween.

In addition, the sensor portion 11*a* is formed by employing the MEMS technology, thus allowing reducing a shape of the sensor portion proper to a unit of size on the order of less than 10 mm. As a result, it is possible to reduce a size of the humidity detection sensor 11 overall, thereby facilitating installing the humidity detection sensor 11 into a confined space.

Figure 4:
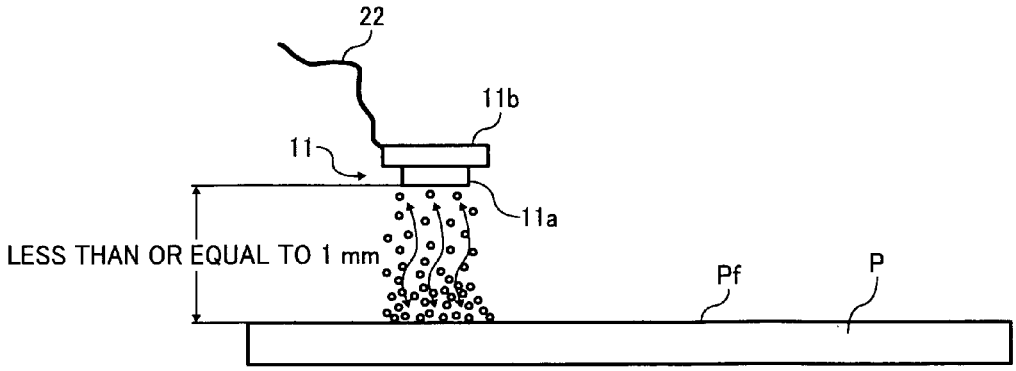
FIG. 4 is a schematic diagram depicting a circumstance wherein the humidity detection sensor that is depicted in FIG. 3 ascertains a movement of moisture from a print paper.

FIG. 4 is a schematic diagram depicting a state of the movement of moisture from the print paper P that has been humidity regulated, i.e., humidity controlled, with respect to the humidity detection sensor 11 that is installed so as to make contact with the print paper P that is in the condition thus described. In the present circumstance, the sensor portion 11*a* of the humidity detection sensor 11 is positioned such that a distance, i.e., an interstice, between the sensor portion 11*a* of the humidity detection sensor 11 and an obverse surface Pf of the print paper P is less than or equal to 1 mm.

Figure 5:
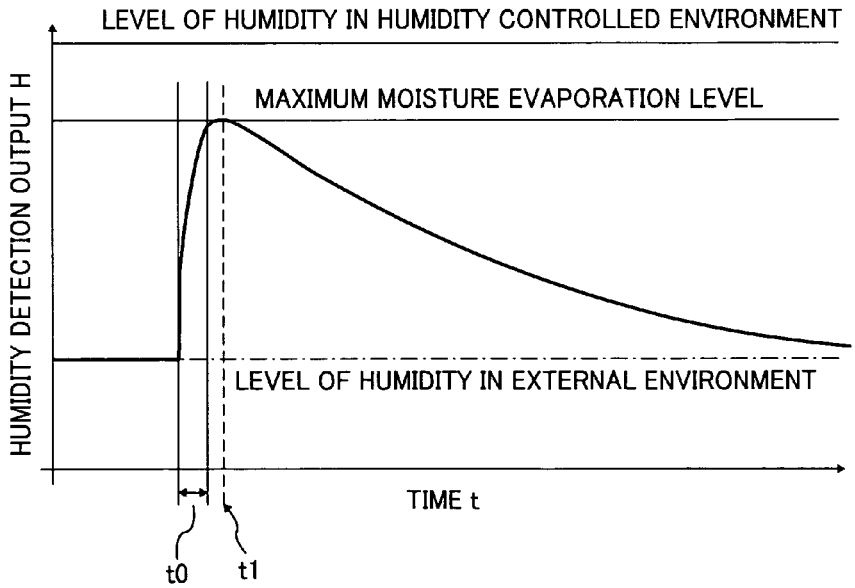
FIG. 5 depicts a relationship between time and an output of the humidity detection sensor.

FIG. 5 is a graph depicting a relationship between a time t and a detected output H of the humidity detection sensor 11 that is depicted in FIG. 4, employing the relationship between the time and the detected humidity output H in order to depict a behavior of the moisture that would occur in a close proximity to the obverse surface of the print paper P when the print paper P, having been humidity controlled in an environment condition of a high humidity, is left in an external environment, i.e., an ambient environment, comprising a lower humidity than the humidity of the humidity controlled environment.

Figure 6:
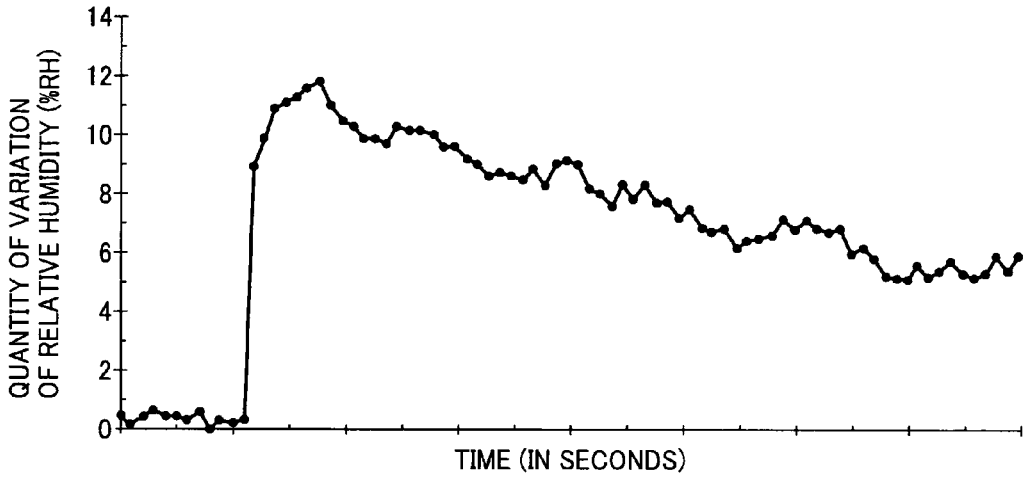
FIG. 6 depicts a relationship between time and a quantity of a variation of relative humidity of the print paper.

The moisture that naturally evaporates from the print paper P experiences a tendency to change slowly, depending upon an equilibrium between the moisture upon the print paper P and the external environment, i.e., the ambient environment, such as is depicted in FIG. 6, rather than evaporating in a large quantity all at once.

When the print paper P is left in the external environment, i.e., the ambient environment, a differential arises between the state of the moisture that is contained within the print paper P and the state of the moisture that is contained within the external environment, i.e., the ambient environment, and thus, by way of attempting to maintain the equilibrium between the state of the moisture that is contained within the print paper P and the state of the moisture that is contained within the external environment, i.e., the ambient environment, the print paper P discharges the moisture that has been adsorbed by the print paper P.

The reason is that a distribution of the moisture that is thus discharged, i.e., a water vapor density distribution, is formed over a passage of time, such that the moisture that is discharged from the print paper P increases until a prescribed time is reached, and furthermore, in order to attempt to maintain the equilibrium between the moisture that is discharged from the print paper P and an atmosphere that is external thereto, the moisture content quantity that is discharged from the print paper P is briefly reduced, and the humidity detection output H arrives at a value that approaches the humidity of the external environment, i.e., the humidity of the ambient environment, such that a curve of a distribution of a quantity of the moisture that is discharged takes a form such as is depicted in FIG. 5.

As the print paper P is conveyed from the print paper feed cartridge 9, when the phenomenon described herein is observed in the near proximity to the obverse surface of the print paper P, i.e., within a prescribed space in the near proximity to the obverse surface Pf of the print paper P, the quantity of the moisture that is discharged from the print paper P reaches a maximum from a time $t_0$ wherein the print paper P traverses the location whereupon the print paper P is in opposition to the humidity detection sensor 11, i.e., the sensor portion 11*a*, to a time $t_1$, whereupon a given interval of time has elapsed from the time $t_0$.

Figure 7:
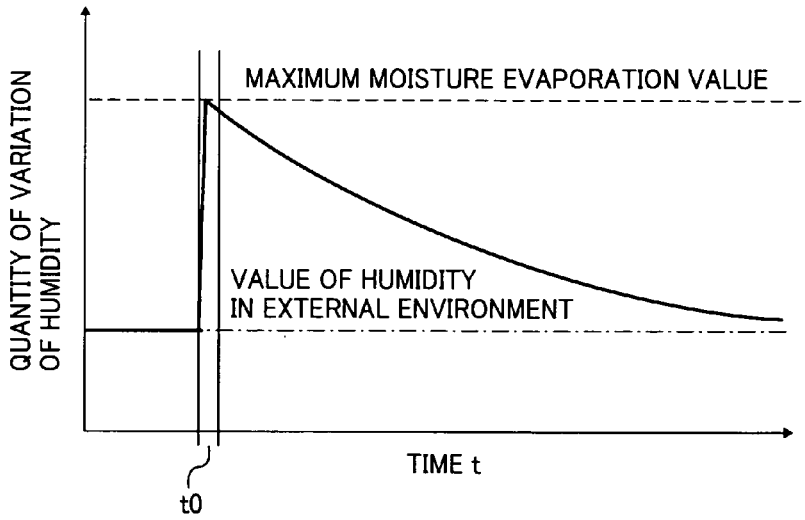
FIG. 7 depicts a state of the movement of the moisture when a print paper that has been humidity controlled in a humidity controlled environment, i.e., a print paper comprising a greater moisture content quantity than a moisture that is present in an ambient environment, is left in an ambient environment that differs from the humidity controlled environment.

FIG. 7 is a graph depicting a state of the movement of the moisture that occurs when the print paper P that has been humidity controlled in a given environment is left in an environment that differs from the humidity controlled environment, in a state wherein the print paper P is halted in opposition to the humidity detection sensor 11, i.e., the sensor portion 11*a*, at a time corresponding to the time $t_0$ wherein the print paper P traverses the location whereupon the print paper P is in opposition to the humidity detection sensor 11, i.e., the sensor portion 11*a*. When the moisture content that is contained within the print paper P is greater than the moisture that flows through the external environment, i.e., the ambient environment, the moisture content evaporates from the print paper P, and thus, the quantity of the variation of the humidity of the print paper P changes so as to be reduced, such as is depicted in FIG. 7. The state of the moisture content of the print paper P attempts to maintain the equilibrium between the moisture content of the print paper P and the moisture content of the external environment, i.e., the ambient environment, and thus, the quantity of the variation of the moisture content of the print paper P is briefly reduced, approaching the moisture content of the external environment, i.e., the ambient environment.

Figure 8:
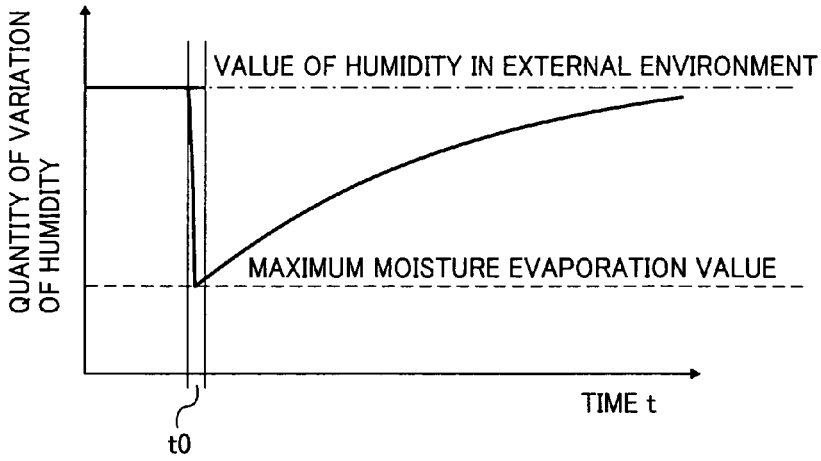
FIG. 8 depicts a state of the movement of the moisture when a print paper that has been humidity controlled in a humidity control environment, i.e., a print paper comprising a lesser moisture content quantity than a moisture that is present in an ambient environment, is left in an ambient environment that differs from the humidity control environment.

Conversely, when the moisture content of the print paper P is less than the moisture content of the external environment, i.e., the ambient environment, the print paper P attempts to adsorb a moisture content from an ambience of the print paper P, and thus, the quantity of the variation of the humidity of the print paper P changes to as to increase, such as is depicted in FIG. 8. The state of the moisture content of the print paper P attempts to maintain the equilibrium between the moisture content of the print paper P and the moisture content of the external environment, i.e., the ambient environment, and thus, the quantity of the variation of the moisture content of the print paper P is briefly reduced, approaching the moisture content of the external environment, i.e., the ambient environment. It is to be understood that, when no differential exists between the state of the moisture content of the print paper P and the state of the moisture content of the external environment, i.e., the ambient environment, no change arises in the quantity of the variation of the humidity.

It is thus apparent that the moisture content of the print paper P changes constantly depending upon the external environment, i.e., the ambient environment. Put another way, it is possible, in order to ascertain the state of the moisture content of the print paper P at an arbitrary timing, to determine, by way of the humidity detection sensor 11, i.e., the sensor portion 11*a*, the state of the moisture content that is contained by the print paper P at a time when a detection of the moisture content is performed, by ascertaining the maximum value, from the commencement of the detection of the moisture content that moves as moisture between the print paper P and the external environment, i.e., the ambient environment, to the time whereat the quantity of the variation of the moisture content reaches the maximum.

Figure 9:
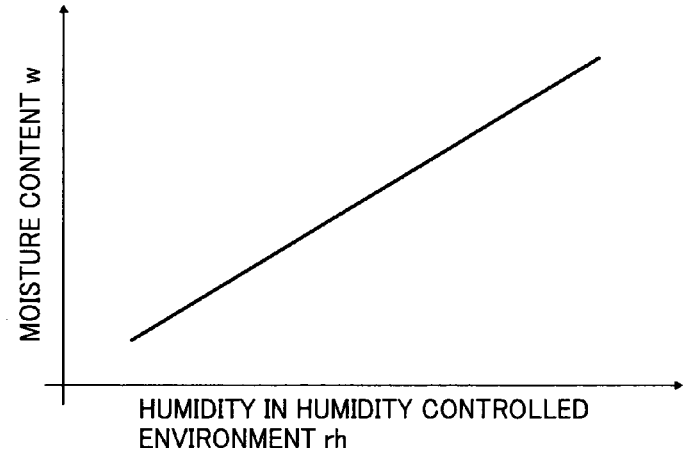
FIG. 9 depicts a relationship between the humidity of the humidity controlled environment and the moisture content of the print paper.

FIG. 9 is a graph depicting a relationship between the humidity of the humidity controlled environment, i.e., the relative humidity, rh, which regulates the state of the moisture content of the print paper P, and the state of the moisture content of the print paper P that is humidity controlled, i.e., the moisture content W. It is apparent that, when the humidity of the humidity controlled environment is low, the moisture that is contained within the print paper P, i.e., the moisture content of the print paper P, falls into a low state thereof, whereas, when the humidity of the humidity controlled environment is high, the moisture that is contained within the print paper P, i.e., the moisture content of the print paper P, enters a high state thereof, such as is depicted in FIG. 9.

Figure 10:
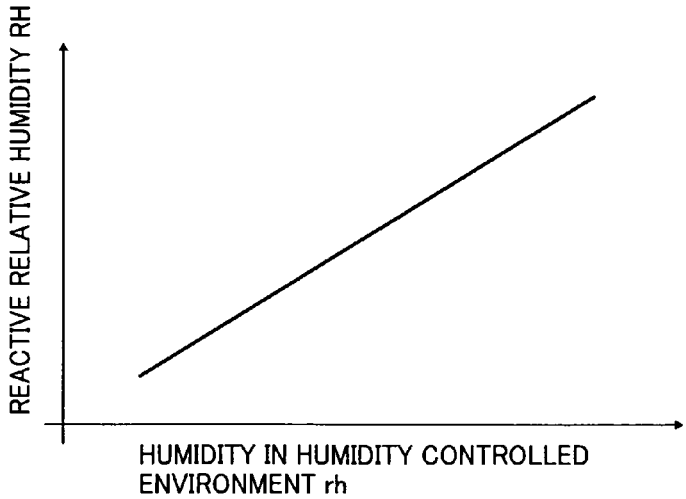
FIG. 10 depicts a variation in a humidity when a print paper that is humidity controlled in a specified humidity controlled environment is left in an ambient environment comprising a humidity of 20% RH.

Furthermore, depicting, in accordance with a relationship between the maximum measured value of the relative humidity, referred to as a reactive relative humidity RH, and the humidity of the humidity controlled environment rh, the movement of the moisture content between a humidity controlled print paper P, comprising the relationship that is depicted in FIG. 9, and the external environment, i.e., the ambient environment, when the humidity controlled print paper P is left in an external environment that differs from the humidity controlled environment, yields a result such as is depicted in FIG. 10.

FIG. 10 is a graph depicting the variation in the humidity when the print paper P that is humidity controlled in a specified humidity controlled environment is left in an ambient environment comprising a relative humidity RH of 20%. As an instance thereof, the print paper P, the moisture content whereof is regulated in a humidity controlled environment of a relative humidity rh of 75%, reaches a state of saturation at the humidity value of the humidity controlled environment, resulting in a state wherein approximately the moisture content of the humidity controlled environment, or a moisture content less than the moisture content of the humidity controlled environment, is contained within the print paper. When the humidity controlled print paper P in such a state is left in the environment comprising the relative humidity RH of 20%, the humidity in accordance with the moisture content that is discharged from the print paper P travels between the relative humidity RH of 20% and the relative humidity RH of 75%. It is to be understood that, in FIG. 10, the reactive relative humidity RH refers to the maximum measured value of the relative humidity.

Accordingly, the moisture that arises from the print paper P varies according to the differential between the humidity of the humidity controlled environment and the humidity of the environment whereupon the print paper P is left, and in addition, given that not all of the moisture that is contained within the print paper P will be discharged, the humidity of the environment whereupon the print paper P is left will be less than or equal to the humidity of the humidity controlled environment even when the maximum value of the quantity of the variation of the moisture is reached.

It is possible to ascertain the moisture content quantity of the print paper P from the graph, depicted in FIG. 9, which depicts the relationship between the humidity rh of the humidity controlled environment and the moisture content W, and the graph, depicted in FIG. 10, which depicts the relationship between the humidity rh of the humidity controlled environment and the reactive relative humidity RH, by employing the maximum value of the detected output value of the relative humidity that is detected by the humidity detection sensor 11, such as is depicted in FIG. 11.

It is to be understood that, in FIG. 11, reference symbol a denotes a relationship between an environmental humidity RH of 20% and the moisture content quantity that is contained within the print paper P, reference symbol b denotes a relationship between an environmental humidity RH of 50% and the moisture content quantity that is contained within the print paper P, and reference symbol c denotes a relationship between an environmental humidity RH of 80% and the moisture content quantity that is contained within the print paper P.

As an instance thereof, a regulated environmental humidity is the humidity of the print paper P when the print paper P is left within the print paper feed cartridge 9 and reaches an equilibrium state thereupon, whereas the environmental humidity is the humidity of the space surrounding the print paper P thereupon. The graph that depicts the relationship between the relative humidity RH and the moisture content quantity W as a percentage, which is depicted in FIG. 11, is preloaded into the memory 14.

As described herein, it is possible to derive the moisture content quantity that is contained within the print paper P at the time of the detection of the humidity by the humidity detection sensor 11, by detecting the maximum quantity of the variation with respect to the value of the environmental humidity of the state of the movement of the moisture, in accordance with the natural evaporation of the moisture from the print paper P, which arises between the obverse surface of the print paper P and the external environment, i.e., the ambient environment, that is in the close proximity to the obverse surface of the print paper P, and the natural adsorption of the moisture upon the print paper P.

Figure 12:
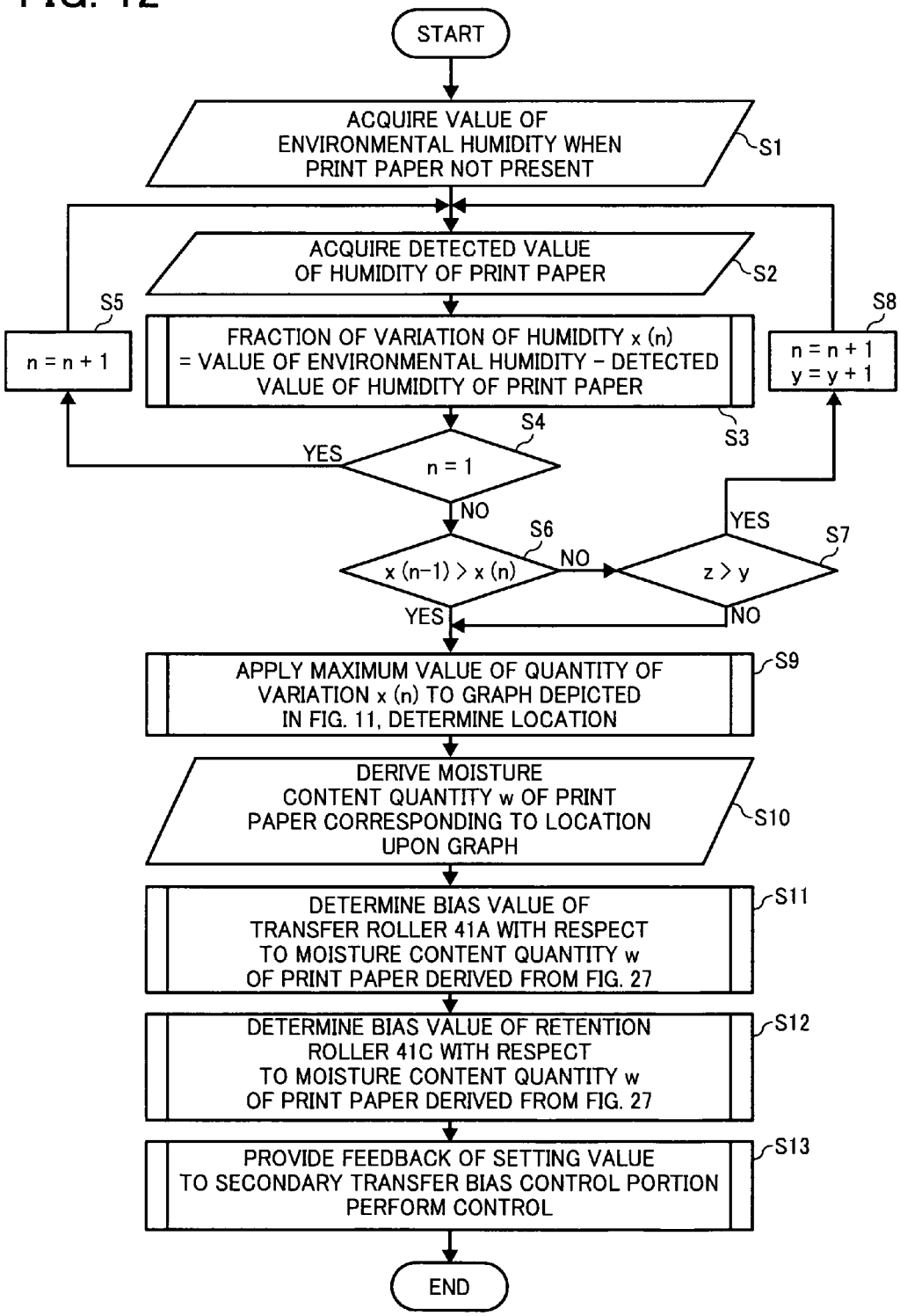
FIG. 12 is a flowchart describing a transfer control that employs a method of measuring the moisture content quantity of the print paper according to the first embodiment of the present invention.

Following is a description of the transfer control by way of the method of measuring the moisture content quantity of the print paper P according to the first embodiment, with reference to the flow chart depicted in FIG. 12.

A memory variable n and y is set upon the measuring portion 13, such that the memory variable n is initialized to 1, and the memory variable y is initialized to 0. In addition, the measuring portion 13 comprises a preset value of a number of comparisons z.

The process commences with step S1, wherein the measuring portion 13 measures the value of the environmental humidity when the print paper P is not present at the location that is in opposition to the humidity detection sensor 11, i.e., the sensor portion 11*a*. Next, in step S2, the measuring portion 13 measures the value of a first instance of the detected humidity of the print paper P when the print paper P is present at the location that is in opposition to the sensor portion 11*a* of the humidity detection sensor 11.

Thereafter, in step S3, the value of the detected humidity of the print paper P that is obtained by the measuring portion 13 in the first measurement thereof is subtracted from the value of the environmental humidity, and a fraction of a variation of humidity X (n=1) is computed with regard to the value of the environmental humidity:

$X(n)$=value of environmental humidity−detected value of humidity of print paper Next, in step S4, a determination is made as to whether or not the measuring portion 13 is n=1. If n=1 is true, the determination is "YES," and the process proceeds to step S5. If n=1 is false, the determination is "NO," and the process proceeds to step S6. Given that the memory variable n is initially set to 1, the process proceeds to step S5.

In step S5, the memory variable n is incremented by 1, and the process proceeds to step S2. In step S2, a second measurement of the detected value of the humidity of the print paper P is performed. Thereafter, the process proceeds to step S3. In step S3, the value of the detected humidity of the print paper P that is obtained in the second measurement of the value thereof is subtracted from the value of the environmental humidity, and a fraction of a variation of humidity x (n=2) is computed with regard to the value of the environmental humidity. Thereafter, the process proceeds to step S4.

In step S4, n=2, and thus, the determination is "NO," whereupon the process proceeds to step S6. In step S6, a fraction of a variation of humidity X (n=n−1) that is computed with the first measurement is compared with a fraction of a variation of humidity X (n=n) that is computed with the second measurement.

If, in step S6, the fraction of the variation of humidity x (n=n) that is computed with the second measurement is greater than or equal to the fraction of the variation of humidity x (n=n−1) that is computed with the first measurement, it is presumed that the maximum value at the time of the detection has not been reached, and thus, the determination thereupon is "NO," whereupon the process proceeds to step S7. In step S7, the memory variable y is compared with the number of comparisons z.

If, in step S7, the memory variable y is less than the number of comparisons z, the process proceeds to step S8, wherein the memory variable y is set to y=y+1, and the memory variable n is set to n=n+1. Thereafter, the process proceeds to step S2, wherein a third detected value of the humidity of the print paper P is measured. Thereafter, in step S3, the detected value of the humidity of the print paper P that is obtained by the third measurement thereof is subtracted from the value of the environmental humidity, and a fraction of a variation of humidity X (n=3) that is computed with the third measurement is computed. Thereafter, the process proceeds to step S4. In step S4, the memory variable n is n=3, and thus, the determination thereupon is "NO," whereupon the process proceeds to step S6.

In step S6, a fraction of a variation of humidity X (n=n−1) that is computed with the second measurement, i.e., the previous measurement, is compared with a fraction of a variation of humidity x (n=n) that is computed with the third measurement, i.e., the current measurement. With the second and succeeding measurements thereof, if, in step S6, the fraction of the variation of humidity x (n=n) that is computed with the current measurement is greater than or equal to the fraction of the variation of humidity x (n=n−1) that is computed with the previous measurement, then the process of steps S2, S3, S4, S6, S7, and S8 is repeated until the value of the memory variable y exceeds the value of the number of comparisons z. It is to be understood that if the fraction of the variation of humidity x (n=n) that is computed with the current measurement is not less than the fraction of the variation of humidity x (n=n−1) that is computed with the previous measurement, or, put another way, if effectively no differential is apparent therebetween, then, even if the value of the memory variable y exceeds the value of the number of comparisons, a determination will be made that the print paper P is adapted to the state of the moisture content of the external environment thereto, whereupon the process proceeds to step S9.

If, in step S6, the fraction of the variation of humidity x (n=n) that is computed with the current measurement is less than the fraction of the variation of humidity x (n=n−1) that is computed with the previous measurement, then the determination that the maximum variation value has been derived is "YES," whereupon the process proceeds to step S9.

In step S9, the measuring portion 13 applies the maximum value x (n) of the quantity of the variation that is measured in step S6 to the graph that is depicted in FIG. 11, and a location is determined upon the moisture content line from such as the value of the environmental humidity and the moisture content lines a, b, and c that corresponds to the maximum value x (n) that is depicted in the graph. Thereafter, in step S10, the moisture content quantity w of the print paper P is derived, as a percentage, that corresponds to the locations of the moisture content quantity lines a, b, and c that are depicted in FIG. 11.

Figures 13, 14:
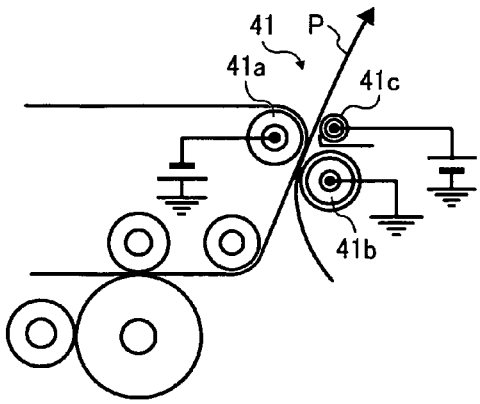
FIG. 13 is a memory table, depicting a relationship between a transfer bias electric potential value according to the moisture content quantity of the print paper, and a retention bias electric potential value.
FIG. 14 is a partial enlargement of a secondary transfer device according to the first embodiment of the present invention.

The graph that is depicted in FIG. 11 is preloaded into the memory 14, together with a bias electric potential value, as a table, that is applied to the transfer roller 41*a* and the retention roller 41*c*, according to the moisture content quantity w, as a percentage; refer to FIG. 13 for particulars. The memory table that is depicted in FIG. 13 is divided into four tiers, wherein the bias electric potential value that is to be applied to the transfer roller 41*a* and the retention roller 41*c* is determined by the moisture content quantity w of the print paper P being less than 4%, greater than or equal to 4% and less than 6%, greater than or equal to 6% and less than 9%, and greater than or equal to 9%, respectively. When the moisture content quantity w of the print paper P shrinks, the resistance value of the print paper P increases, whereas, if the moisture content quantity w of the print paper P grows, the resistance value of the print paper P declines. As a consequence, the bias electric potential value of the electrode of the transfer roller 41*a* is determined so as to increase in accordance with an increase of the moisture content quantity w of the print paper P. Conversely, the bias electric potential value of the retension electrode of the retention roller 41*c* is determined so as to decline in accordance with the increase of the moisture content quantity w of the print paper P. It is to be understood that reference symbols a to h in FIG. 13 refer to the bias electric potential value.

In steps S11 and S12, the measuring portion 13 contrasts the moisture content quantity w thus derived with the memory table that is depicted in FIG. 13, and determines the bias electric potential value of the transfer roller 41*a* and the retention roller 41*c*, according to the moisture content quantity w. In step S13, information relating to the bias electric potential value thus determined is inputted into the CPU 15, and the CPU 15 controls the secondary transfer bias control portion 16, in accordance with the bias electric potential value thus derived.

FIG. 14 is a partial enlargement of the secondary transfer device 41 that is depicted in FIG. 1. The bias electric potential value corresponding to the moisture content quantity of the print paper P that is derived with respect to the transfer roller 41*a* is impressed upon the electrode of the transfer roller 41*a*, and the toner image is transferred to the print paper P, whereas the bias electric potential value corresponding to the moisture content quantity of the print paper P that is derived with respect to the retention roller 41*c* is impressed upon the retension electrode of the retention roller 41*c*, and the print paper P is conveyed to the fixing device 8 while the toner image that is transferred to the print paper P is preserved thereby.

It is possible thereby, as an instance thereof, to employ the transfer roller 41*a* upon the print paper P having the low moisture content and the high resistance state to perform the transfer of the toner image without having to apply an excess of the bias electric potential. The toner image is thus transferred efficiently upon the print paper P, without giving rise to an abnormal electrical discharge, thereby facilitating preventing the white spot image from occurring.

Furthermore, employing the retention roller 41*c* to apply the transfer bias electric potential of the reverse polarity subsequent to the transfer upon the print paper P allows supplementing a retention capability of the toner image upon the print paper P, thus preserving the toner image upon the print paper P without incurring a decline in the retention capability of the toner image, which, in turn, allows preventing the toner scattering from occurring, thereby facilitating the transfer control in accordance with the state of the moisture content of the print paper P, and leading to an improvement of the image quality thereupon.

In addition, it would be permissible to control the other control processes, the charge bias control portion 17, the conveyance control portion 18, or the fixing control portion 19, simultaneously with the control described herein, and it would be possible thereby to appropriately control the charge bias electric potential, the speed of the conveyance of the print paper, and the fixing temperature, respectively, according to the moisture content quantity of the print paper P.

Whereas the determination of the bias electric potential value that corresponds to the moisture content quantity w is determined by the memory table protocol according to the first embodiment, it is to be understood that, in the case of an image forming apparatus that does not require a high precision control, such as an inexpensive image forming apparatus with a limited function set that is not expected to offer a high image quality, a staged method of determination, such as a two stage or a three stage determination, which is not dependent upon the memory table protocol, would also be permissible.

Furthermore, whereas the description according to the first embodiment involves employing the transfer roller 41*a* and the retention roller 41*c* to apply the bias electric potential upon the print paper P, the shape of the material is by no means restricted to the roller shape, such as the transfer roller 41*a* and the retention roller 41*c*, provided that the material is a bias electric potential impression material, which is capable of impressing the transfer bias electric potential and the retention bias electric potential upon the print paper P, in the state wherein the material thereof is in contact with the print paper P.

Put another way, the moisture content of the print paper P that is stacked within such as the print paper feed tray 9 within the image forming apparatus is not limited to being the same for each and every sheet of the print paper P thereupon. The moisture content varies according to the location of the print paper P that is stacked within such as the print paper feed tray 9 therewithin, and, in addition, also changes according to the state of the ambient environment at the time whereat the printing is commenced. Furthermore, the image formation is performed on a per sheet basis of the print paper P for each respective process. Accordingly, it is necessary to acquire the information of the moisture content of the print paper P on the per sheet basis of the print paper P that is extracted from such as the print paper feed tray 9 immediately prior to the image formation being performed.

As a conventional detection of the state of the moisture content of the print paper P, a method is known that employs a moisture meter that detects the state of the moisture content of the print paper P by measuring a rate of microwave adsorption or an infrared moisture meter that detects the degree of moisture content of the print paper P by way of infrared, as well as a method of measuring the resistance by way of detecting a resistance of the obverse surface, as well as a volumetric resistance, of the print paper P, or a method of measuring a surrounding atmosphere by using such as a humidity sensor to detect the electrostatic capacity. Each of the methods thus described, however, requires anywhere from several seconds to several dozen seconds, even with a rapid detection response speed. Thus, when attempting to adopt the detection methods thus described within such as the image forming apparatus, a timing for a single sheet of the print paper P within the image forming apparatus becomes a state wherein the sheet of the print paper P is being conveyed upon the commencement of the print job, and the speed of the conveyance of the sheet of the print paper P will be 200 mm/sec or more.

While it would be possible to acquire the information of the moisture content of the print paper P by temporarily halting the print paper P during the conveyance thereof in order to detect the state of the moisture content of the print paper P, causing the temporary halting of the print paper P during the conveyance of the print paper P will retard the printing speed, thereby causing a printing speed performance of the image forming apparatus to decline appreciably as a result.

In addition, it would be difficult to assert, with the measuring methods described herein, that it would be possible for the degree of the moisture content of the print paper P or the value of the humidity that is obtained by the measurements thereby to accurately measure a state wherein the moisture content quantity of the print paper P on a per sheet basis is affected by the ambient humidity that is in a close proximity thereto. As a consequence, even employing the results of the measurements described herein to determine the control condition of each respective process within the image forming apparatus would complicate the objective of correcting the image anomalies therewith.

Thus, according to the embodiment of the present invention, a process of achieving a prevention of the image anomalies is effected by employing a measuring method, by way of the humidity detection sensor 11, that is capable of rapidly and accurately measuring the state of the moisture content of a single sheet of the print paper P, and reflecting the measurement thus obtained in determining the bias electric potential value of the transfer roller 41*a*, and in the control of the image formation process.

Second Embodiment

Figure 15:
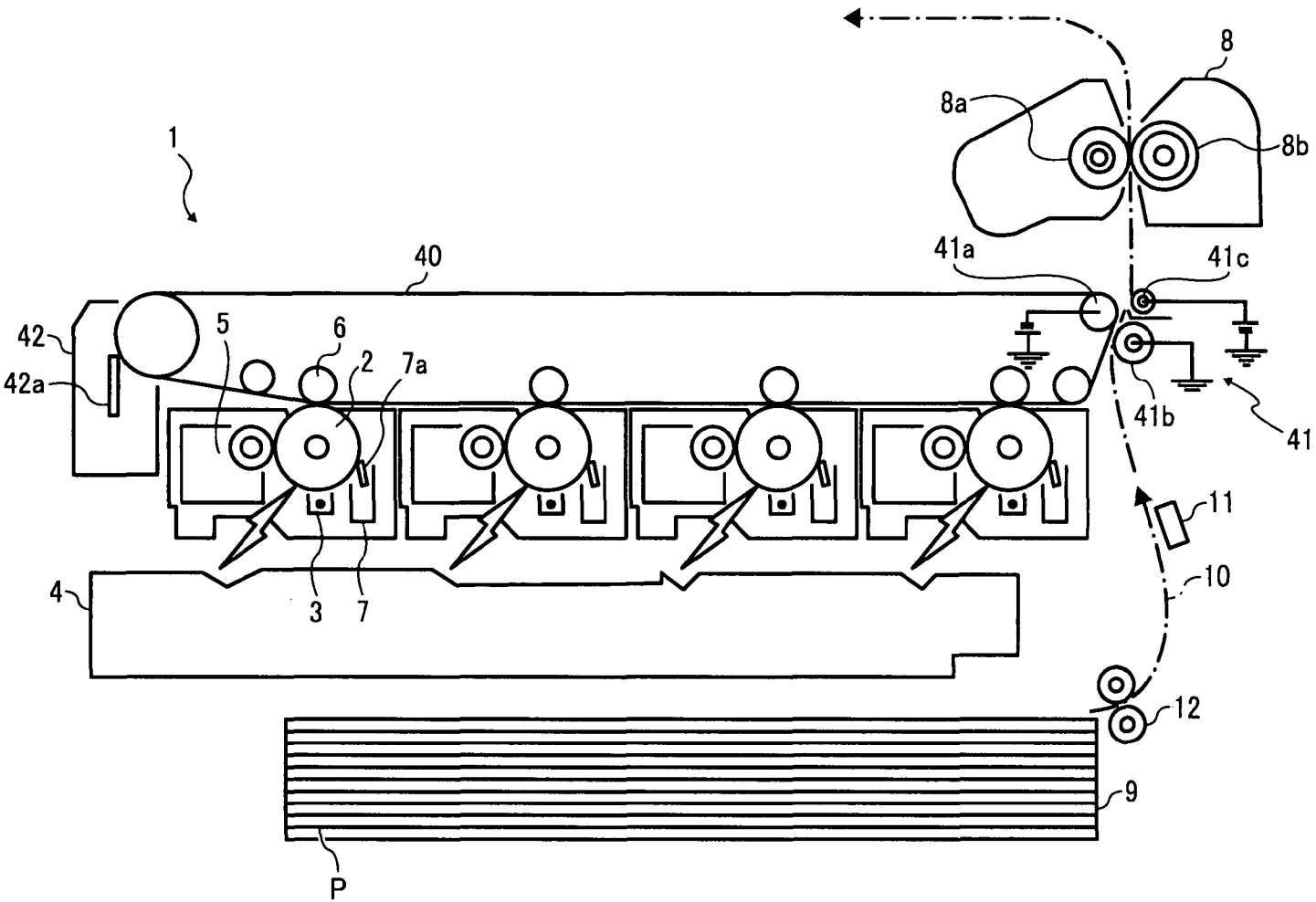
FIG. 15 is a conceptual configuration diagram depicting an image forming apparatus according to a second embodiment of the present invention.

According to a second embodiment, the humidity detection sensor 11 is positioned in a close proximity to the print paper conveyance path 10, which in turn is located between the print paper feed cartridge 9 and the secondary transfer device 41, such as is depicted in FIG. 15. According to the second embodiment, the measurement of the moisture content quantity w of the print paper P is performed when the print paper P is conveyed from the print paper feed cartridge 9 by way of the print paper conveyance path 10. Other elements of the configuration and the control method according to the second embodiment are similar to the same aspects according to the first embodiment, and a redundant description thereupon will be omitted hereinafter.

Figure 16A:
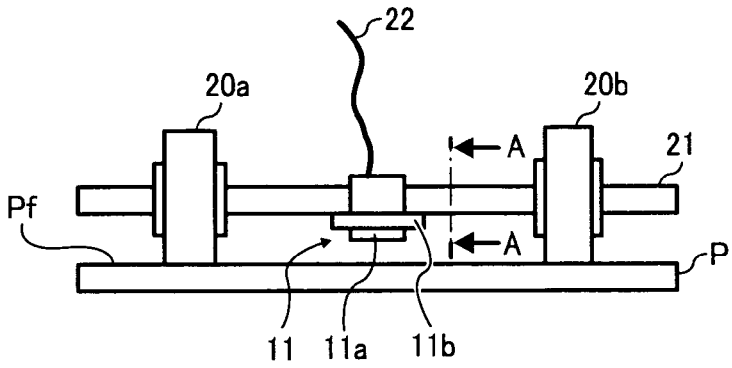
FIG. 16A is a front elevation view.
Figure 16B:
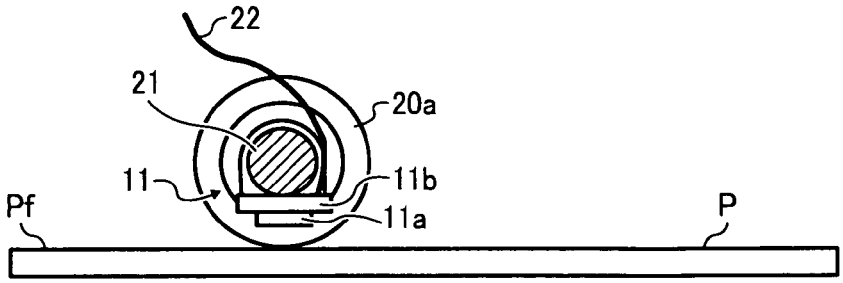
FIG. 16B is a cutaway elevation view along a line A-A in FIG. 16 A.

Put another way, according to the second embodiment, the humidity detection sensor 11 is anchored upon a middle portion of a rod shaped shaft 21, which supports a pair of guide rollers 20*a* and 20*b* as a retention device, allowing the pair of guide rollers 20*a* and 20*b* to rotate freely, and the humidity detection sensor 11 is further positioned in a close proximity to the print paper conveyance path 10, so as to be in opposition to the print paper P wherein a prescribed interstice is opened between the humidity detection sensor 11 and the print paper P, such as is depicted in FIG. 16(*a*) and FIG. 16(*b*).

Each respective guide roller 20*a* and 20*b* comes into contact with the obverse surface of the print paper P during the conveyance of the print paper P, and performs a task of consistently preserving a given distance between the humidity detection sensor 11 and the obverse surface of the print paper P. The distance, i.e., the interstice between the sensor portion 11*a* of the humidity detection sensor 11 and the obverse surface of the print paper P is set to be greater than or equal to 0.1 mm and less than or equal to 2 mm.

The thermal conductivity type humidity sensor, which is formed by applying the MEMS technology, is used as the sensor portion 11*a*. It is thus possible to reduce the shape of the sensor portion 11*a* proper to a unit of size on the order of less than 10 mm. As a result, it is possible to reduce a size of the humidity detection sensor 11 overall, thereby facilitating the installation of the humidity detection sensor 11 into even the confined space of the print paper conveyance path 10.

Each respective guide roller 20*a* and 20*b*, which are located upon either side of the sensor portion 11*a*, are further installed so as to rotate freely with respect to the shaft 21. The print paper P is partially pressed between the pair of guide rollers 20*a* and 20*b*, such that the given distance between the sensor portion ha and the print paper P is consistently preserved, and moreover, a collision between the print paper P and the sensor portion 11*a* is avoided as well.

If the distance between the guide rollers 20*a* and 20*b* and the humidity detection sensor 11, i.e., the sensor portion 11*a*, becomes too short, a risk arises of an interference between the movement of the moisture that occurs between the print paper P and the ambient environment, and thus, it would be desirable for the humidity detection sensor 11 to be installed at a certain remove with respect to the guide rollers 20*a* and 20*b*.

If the humidity detection sensor 11 is located too far away with respect to the guide rollers 20*a* and 20*b*, however, a risk arises that it may not be possible to maintain the given distance between the print paper P and the sensor portion 11*a*, as well as that a conveyance defect may arise, owing to the print paper P being snagged upon the sensor portion 11*a*, all owing to such as a curvature of the print paper P. Accordingly, it would be desirable for each respective guide roller 20*a* and 20*b* to be installed upon a location that is distanced on the order of between 30 mm and 50 mm with respect to the humidity detection sensor 11, i.e., the sensor portion 11*a*.

Figure 17:
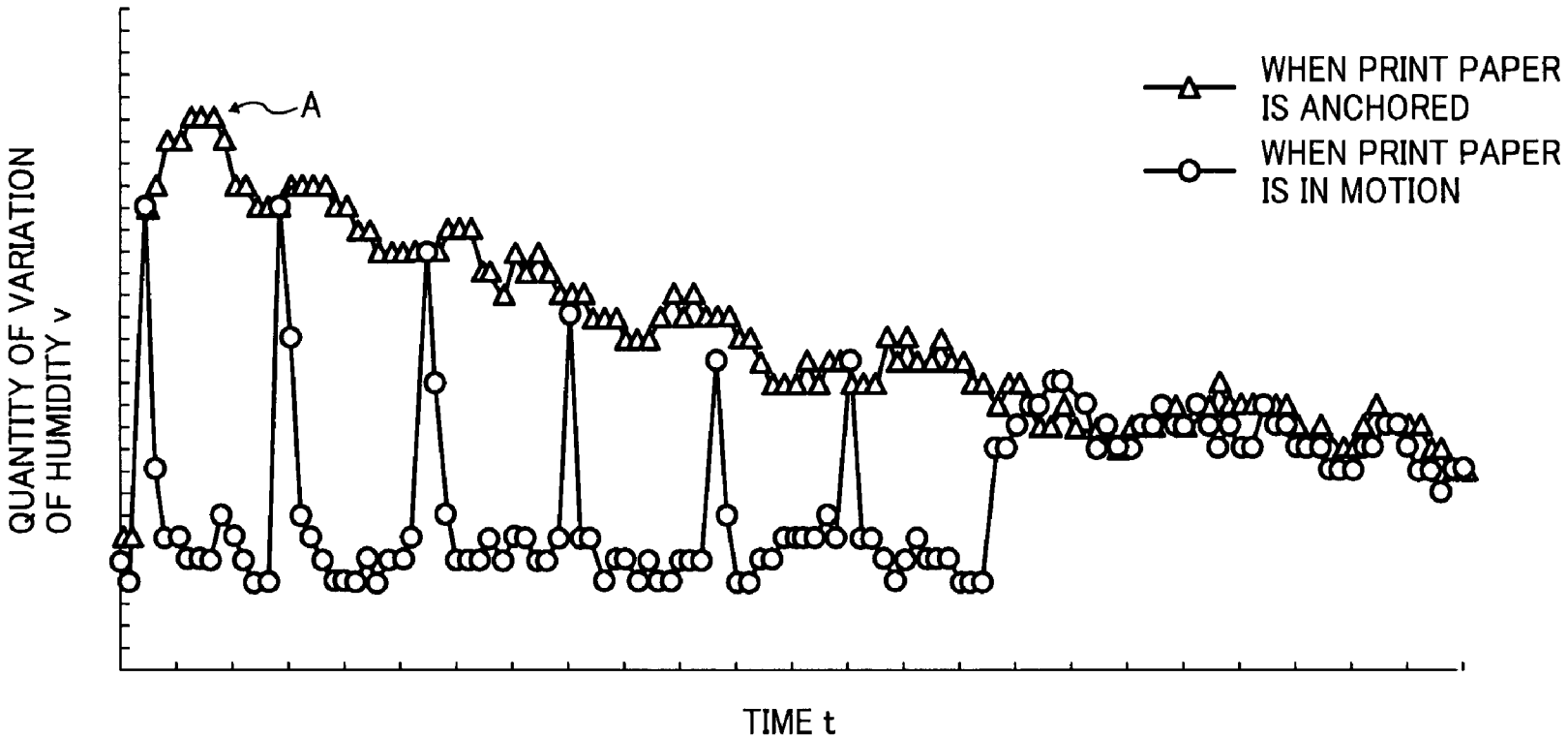
FIG. 17 depicts a relationship between time, the quantity of the variation of the humidity when the print paper is moved, and the quantity of the variation of the humidity when the print paper is anchored.

FIG. 17 is a graph depicting the quantity of the variation of the humidity, i.e., the movement of the moisture content, on a second by second basis at an arbitrary location of transit, when the print paper P, which is humidity controlled within the specified humidity environment, and in a state wherein the given distance is maintained with respect to the humidity detection sensor, 11, i.e., the sensor portion 11*a*, is moved with respect to the humidity detection sensor, and the quantity of the variation of the humidity, i.e., the movement of the moisture content, on a second by second basis when the print paper P, which is humidity controlled within the specified humidity environment, and in a state wherein the given distance is maintained with respect to the humidity detection sensor, 11, i.e., the sensor portion 11*a*, is anchored, i.e., halted. It is to be understood that, with regard to the condition of the conveyance of the print paper P, the speed whereat the print paper P traverses the humidity detection sensor 11, i.e., the sensor portion 11*a*, is 210 mm/sec, and that the print paper P that is used herein is an A4 size print paper that has been humidity controlled under a consistent environment.

As should be apparent from the graph in FIG. 17, it is possible to verify the state wherein the quantity of the variation of the humidity, i.e., the movement of the moisture content, varies when the print paper P traverses the humidity detection sensor 11, i.e., the sensor portion 11*a*. In FIG. 17, the quantity of the variation of the humidity fluctuates dramatically upon intervals of less than 10 seconds apiece. The reason for the dramatic fluctuation thereupon is that a flow of the atmosphere arises upon the obverse surface Pf of the print paper P, in accordance with the movement of the print paper P, and an area wherein the moisture is many, as well as an area wherein the moisture is few, arises in a close proximity to the obverse surface Pf of the print paper P as a result of the flow of the atmosphere thereupon.

It is apparent, upon comparing a value of the quantity of the variation of the humidity when the print paper P is moving with a value of the quantity of the variation of the humidity when the print paper P is anchored, i.e., halted, that a state change of the movement of the moisture that occurs upon the print paper P that is anchored, i.e., halted, with the passage of time, occurs with a passage of time that is similar to the state change thereof that occurs upon the print paper P that is moving. With the detection of the quantity of the variation of the humidity of the print paper P when the print paper P is moving, however, it is not possible to detect the maximum value of the variation of the moisture content that is contained by the print paper P, i.e., a portion designated "A" in FIG. 17, when the print paper P initially traverses the humidity detection sensor 11, i.e., the sensor portion 11*a*, such as is detected in FIG. 17.

It would be possible to resolve the problem described herein by increasing a sensitivity of detection by positioning the humidity detection sensor 11, i.e., the sensor portion 11*a*, at a distance that is maximally close to the obverse surface Pf of the print paper P, i.e., greater than or equal to 0.1 mm and less than or equal to 2 mm, and furthermore, by improving the sensitivity of detection and the response speed by adopting the thermal conductivity type humidity sensor, which is formed by employing the MEMS technology, and which is capable of performing the humidity measurement by way of a high speed response in a unit of less than 10 mm/sec, as the sensor portion 11*a*. The measurement method that is used thereupon would use a variation of a thermal conductivity of an atmospheric gas according to a concentration of the water vapor, i.e., the humidity. It would be possible, as an instance thereof, to employ a humidity sensor that is disclosed according to paragraph 0081 of Japanese Patent No. 2889909.

Figure 18:
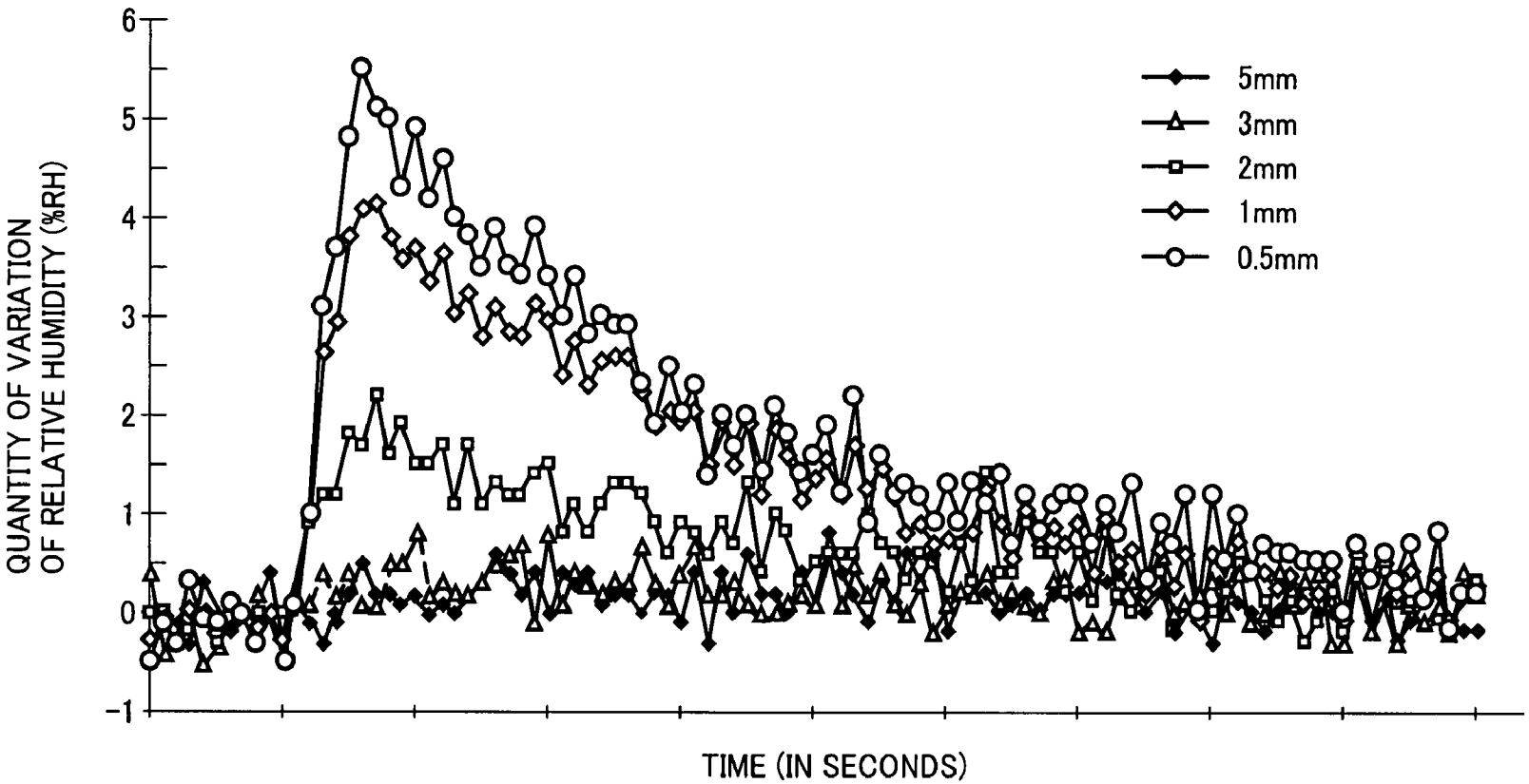
FIG. 18 depicts a relationship between time and the quantity of the variation of the humidity when a distance between the humidity detection sensor and the print paper is altered.

FIG. 18 depicts a graph of a differential of a quantity of variation of a relative humidity, i.e., the detected quantity of variation, by way of a difference in a measurement distance from the obverse surface Pf of the print paper P, i.e., the distance between the obverse surface Pf of the print paper P and the sensor portion 11*a*, as a quantity of variation of a relative humidity when measured in the state wherein the print paper P is positioned in opposition to the sensor portion 11*a*. When the measurement distance with respect to the obverse surface Pf of the print paper P is 3 mm or 5 mm, such as is depicted in FIG. 18, practically no observable difference exists between the quantity of variation of the relative humidity and an indoor environment, and it is thus not possible to ascertain the movement of the moisture content from the print paper P, i.e., the quantity of variation of the relative humidity thereof. When the distance from the print paper P to the sensor portion 11*a* is less than or equal to 2 mm, however, it becomes possible to ascertain the quantity of variation of the relative humidity of the print paper P.

When the distance from the print paper P to the sensor portion 11*a* is 2 mm, however, the quantity of variation is small, even though a noticeable difference can be found between the quantity of variation of the relative humidity and the indoor environment. As a consequence, the ascertainment thereupon is normally considered to be complicated when the state change of the movement of the moisture content is small to begin with.

According to the Cited Non-Patent Reference 1 and 2, when the moisture evaporates, it is presumed that a region known as a diffusion layer is present, whereupon the movement of the moisture content, i.e., the water vapor, is performed in a linear manner from a location whereat the evaporation commences. As an instance thereof, a steady movement of the water vapor in a fixed quantity is possible for water, when the water is at a surface level, and it is presumed to be possible for a thickness of the diffusion layer, when not affected by such as a wind acting thereupon, to be present within a region ranging from surface level to a height on the order of 10 mm in a perpendicular direction, and for the thickness of the diffusion layer to be present up to a height of 2 mm to 3 mm or thereabouts without difficulty even if the wind does exert an effect thereupon.

With the print paper P, however, the moisture content that is contained by the print paper P varies first of all according to the ambient environment. Thus, the movement of the water vapor is not steady, and, in addition, the quantity of the water vapor is not constant, such that, when dealing with a very small quantity of moisture, the region of the thickness of the diffusion layer becomes smaller still. Furthermore, an inverse movement of the moisture content may arise, depending upon the state of equilibrium between the state of the moisture content of the print paper P and the ambient environment, wherein the print paper P adsorbs the moisture content of the ambient environment. The diffusion layer is considered to be present in such a circumstance as well as in the other circumstances described herein. The thickness of the diffusion layer in the present circumstance forms a region less than 1 mm with respect to the print paper P within the ambient environment, and when the distance from the print paper P to the sensor portion 11*a* exceeds 1 mm, the movement of the moisture content becomes nonlinear, which in turn is more easily affected by the ambient environment, and it is considered thereby that an accurate measurement of the value of the movement of the moisture content becomes impossible.

Accordingly, it would be preferable to position the sensor portion 11*a*, even under identical conditions, in a space that is less than or equal to 2 mm from the obverse surface Pf of the print paper P, such that it is possible to substantially ascertain the state change of the movement of the moisture content, i.e., the quantity of variation of the relative humidity, and it would be possible to perform the detection thereof even when the sensor portion 11*a* comes into contact with the obverse surface Pf of the print paper P. Bringing the sensor portion 11*a* into contact with the obverse surface Pf of the print paper P when the print paper P is being conveyed at a high speed within the image forming apparatus, i.e., a speed of 200 mm/sec or more, however, raises a risk that the obverse surface Pf of the print paper P may be torn or the sensor portion 11*a* may be damaged, and when taking into account such as a flapping operation, i.e., an irregular movement, of the print paper P during conveyance, it is considered that the distance from the obverse surface Pf of the print paper P to the sensor portion 11*a* must be greater than or equal to 0.1 mm.

Accordingly, it would be preferable for the measurement distance from the obverse surface Pf of the print paper P to be greater than or equal to 0.1 mm and less than or equal to 2 mm, and, taking into account such as a circumstance wherein the state change of the moisture content of the print paper P is small to begin with, it would be maximally preferable for the distance from the obverse surface Pf of the print paper P to be treated as less than or equal to 1 mm, whereat the quantity of variation may be substantially ascertained.

Accordingly, it is possible to ascertain, with a high degree of precision, at high speed, and with a strong degree of sensitivity, the movement of the moisture content, i.e., the quantity of variation of the relative humidity, which arises between the print paper P and the ambient environment, and it is thereby further possible to ascertain the maximum value of the state change of the moisture content during the interval when the print paper P traverses the sensor portion 11*a*.

Furthermore, even if the sensitivity of detection and the response speed of the sensor portion 11*a* are improved, the time taken by the sheet of print paper to traverse the sensor portion 11*a* is shortened when detecting the moisture content of such as a sheet of print paper of a small size, i.e., A6 or B6 size. It would be permissible, as a countermeasure in a circumstance wherein, as a consequence, a possibility arises of not being able to ascertain the maximum value of the state change of the moisture content of the print paper P while the print paper P traverses the sensor portion 11*a*, due to the shortness of the time taken for the traversing thereby of the print paper P, to predict the maximum value of the state change of the moisture content from a trend of a variation of the detected value during the period whereupon the print paper P traverses the sensor portion 11*a*, and to employ the value thus predicted to derive the moisture content of the print paper P.

Figure 19:
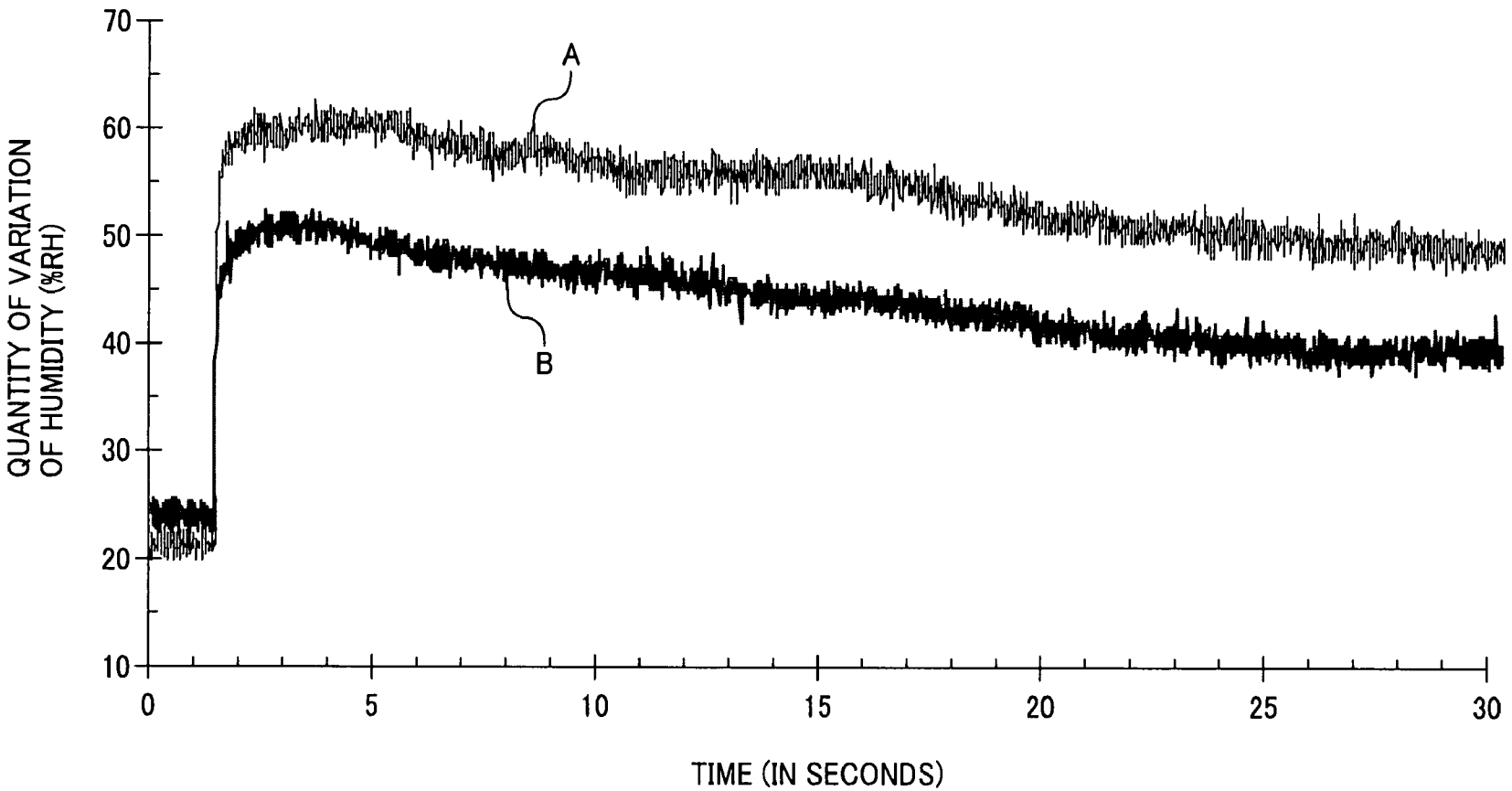
FIG. 19 depicts the quantity of the variation of the humidity when a print paper that is humidity controlled in a given humidity environment is left out in a different humidity environment.

FIG. 19 is a graph depicting the moisture content state, i.e., the quantity of the variation of the humidity, when the print paper P that is humidity controlled in a different humidity environment is left out in an environment comprising an arbitrary measured humidity. In FIG. 19, a circumstance of the quantity of variation of the humidity, wherein a humidity controlled print paper A and B, that are respectively humidity controlled in environments wherein the humidity is set to an RH of 75% and RH of 60%, and the print paper A and B thus humidity controlled are left in an environment for measurement wherein the humidity is set to an RH of 20%, is depicted as a result of a detection that is detected by employing the humidity detection sensor 11, i.e., the sensor portion 11*a*, which is positioned in a location at a distance of less than or equal to 1 mm from an obverse surface of the print paper A and B.

It is apparent that, even if a moisture characteristic of the humidity controlled print paper A and B varies, the graph of the time and the quantity of the variation required to reach the maximum value thereof denote an approximately similar trend, such as is depicted in FIG. 19. It is thus possible, using the trend thus depicted, to predict the maximum value of the trend of the quantity of the variation from the trend of the variation of the value that is detected while the print paper P traverses the sensor portion 11*a*, and to derive the moisture content of the print paper P from the value that is thus predicted.

Figure 20:
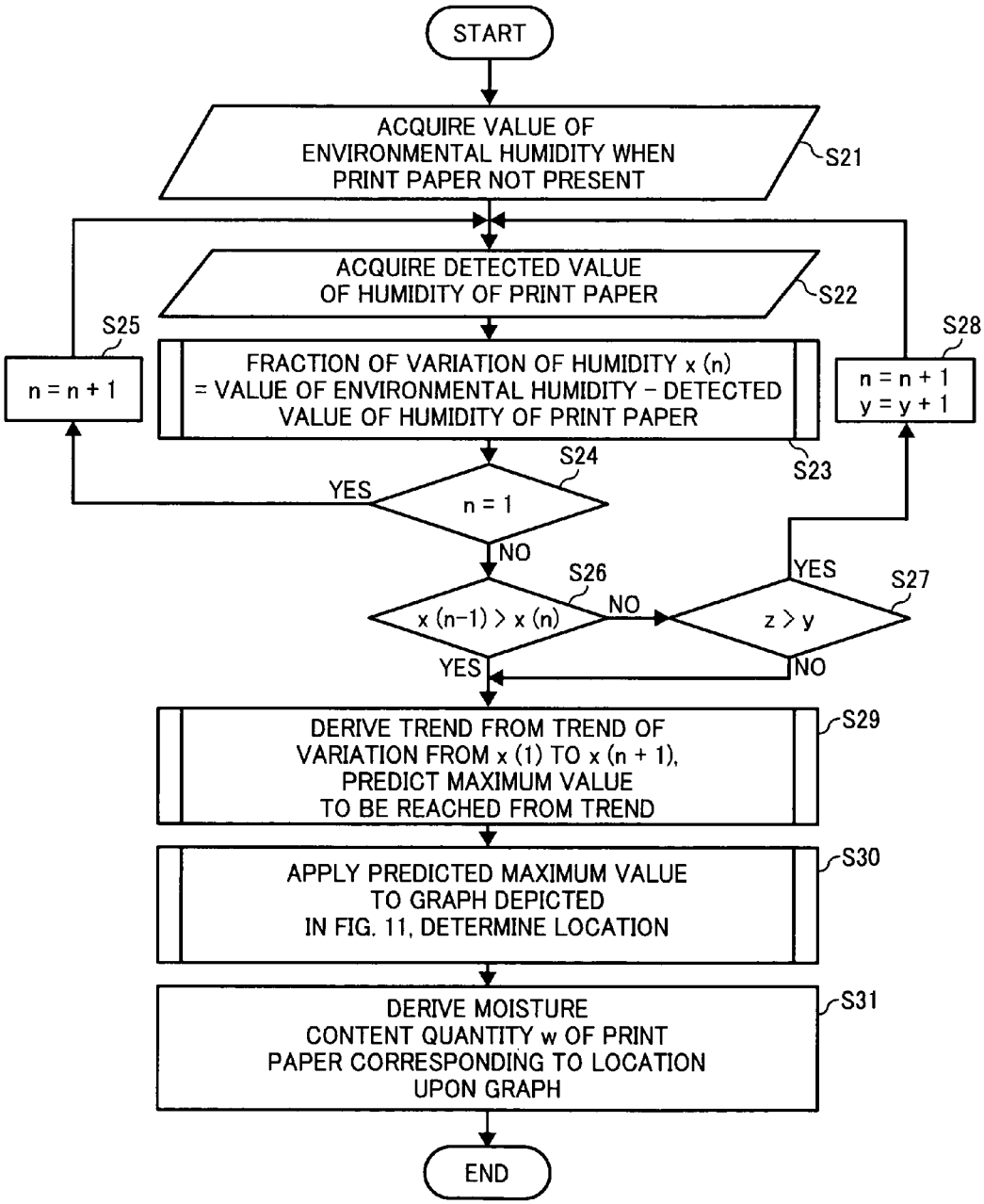
FIG. 20 is a flowchart describing a transfer control that employs a method of measuring the moisture content quantity of the print paper according to the second embodiment of the present invention.

Following is a description of the transfer control that employs the method of measuring the moisture content according to the second embodiment, with reference to the flowchart that is depicted in FIG. 20.

A memory variable n and y is set upon the measuring portion 13, in a manner similar to the transfer control according to the first embodiment. An initial value of the memory variable n is 1, and an initial value of the memory variable y is 0. In addition, the measuring portion 13 comprises a preset value of a number of comparisons z.

The process commences with step S21, wherein the measuring portion 13 measures the value of the environmental humidity at the location that is in opposition to the humidity detection sensor 11, i.e., the sensor portion 11*a*, prior to the print paper P being conveyed thereupon. Thereafter, in step S22, the measuring portion 13 measures, once again, the value of the detected humidity of the print paper P when the print paper P is conveyed to the location that is in opposition to the humidity detection sensor 11 (the sensor portion 11*a*).

Thereafter, in step S23, the value of the detected humidity of the print paper P that is obtained by the measuring portion 13 in a first measurement thereof is subtracted from the value of the environmental humidity, and a fraction of a variation of humidity x (n=1) is computed with regard to the value of the environmental humidity. Next, in step S24, a determination is made as to whether or not the measuring portion 13 is n=1. If n=1 is true, the determination is "YES," and the process proceeds to step S25. If n=1 is false, the determination is "NO," and the process proceeds to step S26. Given that the memory variable n is initially set to 1, the process proceeds to step S25. In step S25, the memory variable n is incremented by 1, and the process proceeds to step S22. In step S22, a second measurement of the detected value of the humidity of the print paper P is performed, and the process proceeds to step S23 thereafter. In step S23, the value of the detected humidity of the print paper P that is obtained in the second measurement of the value thereof is subtracted from the value of the environmental humidity, and a fraction of a variation of humidity x (n=2) is computed with regard to the value of the environmental humidity. Thereafter, the process proceeds to step S24.

In step S24, n=2, and thus, the determination is "NO," whereupon the process proceeds to step S26. In step S26, a fraction of a variation of humidity x (n=n−1) that is computed with the first measurement is compared with a fraction of a variation of humidity x (n=n) that is computed with the second measurement.

If, in step S26, the fraction of the variation of humidity x (n=n−1) is less than the fraction of the variation of humidity x (n=n), or, put another way, if the fraction of the variation of humidity x (n=n) that is computed with the second measurement is greater than or equal to the fraction of the variation of humidity x (n=n−1) that is computed with the first measurement, it is presumed that the maximum value at the time of the detection has not been reached, and thus, the determination thereupon is "NO," whereupon the process proceeds to step S27.

If, in step S27, the memory variable y is less than the number of comparisons z, the process proceeds to step S28, wherein the memory variable y is set to y=y+1, and the memory variable n is set to n=n+1. Thereafter, the process proceeds to step S22, wherein a third detected value of the humidity of the print paper P is measured. Thereafter, in step S23, the detected value of the humidity of the print paper P that is obtained by the third measurement thereof is subtracted from the value of the environmental humidity, and a fraction of a variation of humidity x (n=3) that is computed with the third measurement is computed. Thereafter, the process proceeds to step S24. In step S24, the memory variable n is n=3, and thus, the determination thereupon is "NO," whereupon the process proceeds to step S26.

In step S26, a fraction of a variation of humidity X (n=n−1) that is computed with the second measurement, i.e., the previous measurement, is compared with a fraction of a variation of humidity x (n=n) that is computed with the third measurement, i.e., the current measurement. With the second and succeeding measurements thereof, if, in step S26, the fraction of the variation of humidity x (n=n) that is computed with the current measurement is greater than or equal to the fraction of the variation of humidity x (n=n−1) that is computed with the previous measurement, then the process of steps S22, S23, S24, S26, S27, and S28 is repeated until the value of the memory variable y exceeds the value of the number of comparisons z. It is to be understood that if the fraction of the variation of humidity x (n=n) that is computed with the current measurement is not less than the fraction of the variation of humidity x (n=n−1) that is computed with the previous measurement, or, put another way, if effectively no differential is apparent therebetween, then a determination will be made that the print paper P is adapted to the state of the moisture content of the external environment thereto, whereupon the process proceeds to step S29.

If, in step S26, the fraction of the variation of humidity x (n=n) that is computed with the current measurement is less than the fraction of the variation of humidity x (n=n−1) that is computed with the previous measurement, then the determination that the maximum variation value has been derived is "YES," whereupon the process proceeds to step S29. The process described herein is performed repeatedly during the interval from the time when a leading edge of the print paper P traverses the sensor portion 11*a* to the time when a trailing edge of the print paper P traverses the sensor portion 11*a*, and the quantity of the variation of the humidity is acquired thereby.

In step S29, the trend of the variation of the quantity of the variation of the humidity is derived from the plurality of values of the quantity of the variation that is obtained while the print paper P traverses the sensor portion 11*a*, the maximum value to be reached is predicted from the trend thus derived, and the process proceeds to step S30.

In step S30, the measuring portion 13 applies the maximum value to be reached of the quantity of the variation that is predicted in step S29 to the graph that is depicted in FIG. 11, and a location is determined upon the moisture content quantity line from such as the value of the environmental humidity and the moisture content lines a, b, and c that corresponds to the maximum value to be reached that is depicted in the graph. Thereafter, in step S31, the moisture content quantity w of the print paper P is derived, as a percentage, that corresponds to the locations of the moisture content lines a, b, and c that are depicted in FIG. 11.

The measuring portion 13 contrasts the moisture content quantity w thus derived with the memory table that is depicted in FIG. 13, and determines the bias electric potential value of the transfer roller 41*a* and the retention roller 41*c*, according to the moisture content quantity w. The CPU 15 performs the controls described herein in accordance with the bias electric potential values described herein. The controls described herein, however, are similar to the process of step S11 to step S13 that is depicted in FIG. 12, and thus, a description of the steps in FIG. 20 that correspond to step S11 to S13 in FIG. 12 will be omitted hereinafter.

In addition, in order to more accurately ascertain the time wherein the print paper P traverses the location that is in opposition to the sensor portion 11*a* of the humidity detection sensor 11, it would be permissible to install a switch (not shown) in a close proximity to the sensor portion 11*a*, which switches on or off when the print paper P traverses the sensor portion 11*a*, to perform the detection by the humidity detection sensor 11 while the switch is turned on by the print paper P traversing the humidity detection sensor 11, and to derive the maximum value to be reached from the trend of the variation of the humidity that is acquired during the interval wherein the electrical switch thus described is turned on. It is to be understood that such as a light reflecting photo sensor switch, which would be capable of detecting the presence of the print paper P, or a microcircuit switch, which would be capable of being turned on and off at a low load, would be preferable as the switch thus used.

Third Embodiment

Figure 21A:
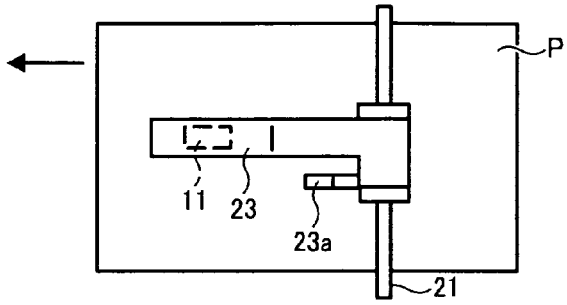
FIG. 21A is a plan view.
Figure 21B:
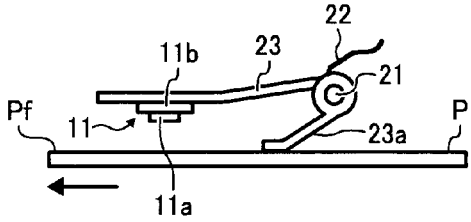
FIG. 21B is an elevation view.

FIG. 21 A is a conceptual plan view depicting an installation structure of the humidity detection sensor 11 according to a third embodiment, and FIG. 21 B is an side view thereof.

According to the third embodiment, such as is depicted in FIG. 21 A and FIG. 21 B, the humidity detection sensor 11 is installed in a close proximity to the conveyance path of the print paper P, being bonded upon a rear surface, i.e., on a side facing the print paper conveyance path, of a leading edge side of a sensor attachment component 23, comprising a thin sheet shape, as a support unit of the humidity detection sensor 11.

The sensor attachment component 23 is made to rotate freely upon a middle portion of a rod shaped shaft 21, which passes through the sensor attachment component 23. A rod shaped guide component 23*a*, extending in a line with a side surface of the sensor attachment component 23, is installed upon a base edge side of the sensor attachment component 23, so as to comprise effectively a single unit with the sensor attachment component 23. A leading edge portion of the guide component 23*a* is presumed to be capable of freely making contact with the print paper P that moves along the conveyance path thereof (not shown).

The guide component 23*a* is shorter than the sensor attachment component 23, and is located upon a side that is lower than the sensor attachment component 23. In FIG. 21 A and FIG. 21 B, the print paper P is conveyed from right to left, i.e., in a direction indicated by an arrow in FIG. 21 A and FIG. 21 B. It is to be understood that the configuration of the humidity detection sensor 11 is similar to the configuration of the humidity detection sensor 11 according to the second embodiment.

Given an installation structure of the humidity detection sensor 11 according to the third embodiment, when the print paper P moves upon the conveyance path, the leading edge portion of the sensor attachment component 23, wherethrough the shaft 21 is inserted, such that the sensor attachment component 23 is capable of rotating freely upon the shaft 21, rotates toward an upper side when the leading edge portion of the guide component 23*a* comes into contact with the obverse surface Pf of the print paper P, and the humidity detection sensor 11 is installed and maintained at a prescribed distance from the obverse surface Pf of the print paper P. According to the third embodiment, an angle that is formed between the guide component 23*a* and the sensor attachment component 23 is set such that the distance between the sensor portion 11*a* of the humidity detection sensor 11 and the obverse surface Pf of the print paper P is less than or equal to 1 mm.

It would be desirable for the leading edge portion of the guide component 23*a* to comprise a rounded shape, such that the print paper P is not torn by being scoured when coming into contact with the leading edge portion of the guide component 23*a*. In addition, a friction, i.e., a friction coefficient, of the sensor attachment component 23, wherethrough the shaft 21 is inserted so as to allow the sensor attachment component 23 to rotate freely, is reduced, such that the sensor attachment component 23 rotates with a light force applied thereupon. Furthermore, lightening a weight of the sensor attachment component 23 allows the sensor attachment component 23 to operate with a lighter load, and thus, it would be preferable for a plastic material to be employed in forming the sensor attachment component 23.

According to the third embodiment, in order to compensate for a behavior of the print paper P even when a change in the behavior of the print paper P arises while the print paper P is moving past the location that is in opposition to the humidity detection sensor 11, the sensor attachment component 23 and the guide component 23*a* move vertically with regard to the print paper P, thereby maintaining a constant consistent distance between the obverse surface Pf of the print paper P and the sensor portion 11*a*, and in addition, the sensor portion 11*a* moves vertically in order to compensate for the behavior of the print paper P, such that the sensor portion 11*a* is prevented from colliding with the print paper P. Furthermore, it is possible to measure the moisture content quantity w of the print paper P without physically pressing upon the print paper P, and thus, it is possible to adequately measure the moisture content quantity w of the print paper P even in a circumstance wherein the humidity detection sensor 11 is installed in a site wherein it is not possible to physically press upon the print paper P, owing to a certain degree of variation in the behavior of the print paper P thereupon.

Whereas it is necessary, according to the third embodiment, to regulate the distance of the sensor portion 11*a* with respect to the print paper P when detecting the moisture content thereupon, there is no guarantee of being able to acquire the same value when performing a detection upon the print paper P that contains the same moisture content quantity if the distance thus regulated is not consistently maintained at a constant throughout the measurement of the moisture content quantity as well. Accordingly, a modification is performed that maintains the distance from the sensor portion 11*a* to the obverse surface Pf of the print paper P at a constant.

Put another way, there is no guarantee that the print paper P that moves within the apparatus while being conveyed will necessarily move in a manner wherein a consistent behavior is maintained, and thus, a modification is performed such that the measurement is carried out with the regulated distance consistently maintained at a constant, in accordance with the behavior of the print paper P as it moves with respect to the sensor portion 11*a* that detects the moisture content of the print paper P thereupon.

Fourth Embodiment

Figure 22A:
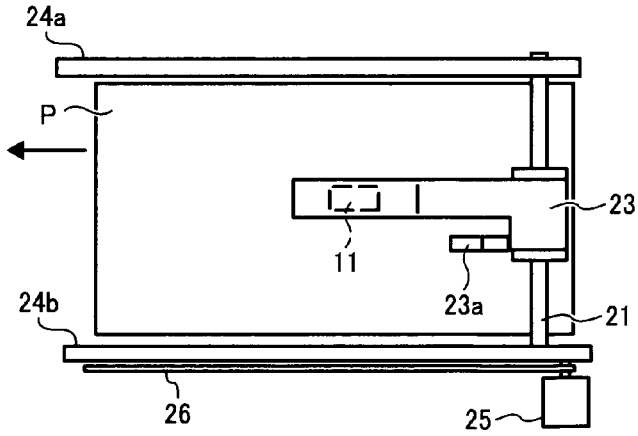
FIG. 22A is a plan view.
Figure 22B:
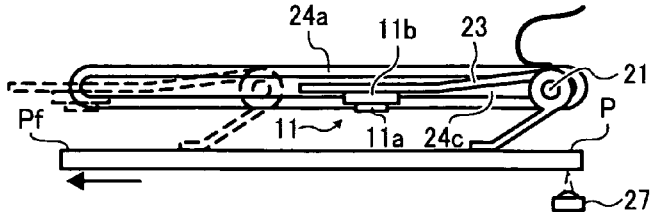
FIG. 22B is an elevation view.

FIG. 22 A is a conceptual plan view depicting an installation structure of the humidity detection sensor 11 according to a fourth embodiment, and FIG. 22 B is an elevation view thereof. It is to be understood that a component depicted in FIG. 22 A and FIG. 22 B comprising a function identical to a component depicted in FIG. 21 A and FIG. 21 B will be designated with an identical reference symbol thereto, and a redundant description thereof will be omitted hereinafter.

According to the fourth embodiment, a pair of slide guide components 24*a* and 24*b* are installed to either side of the conveyance path, and upon an upper portion of the conveyance path, such as is depicted in FIG. 22 A and FIG. 22 B. A depression portion 24*c* is formed by each respective slide guide component 24*a* and 24*b*, and in line with the direction of the conveyance of the print paper P. Both end portions of the shaft 21 are inserted through the depression portion 24*c*.

A motor 25 and a roller (not shown) are anchored to the slide guide component 24*b*, and a drive belt 26 is mounted between a propulsion axis of the motor 25 and the roller. The drive belt 26 is linked to the shaft 21, and it is presumed that it is possible for the shaft 21 to be shuttled back and forth by the drive belt 26 in a direction whereupon the depression portion 24*c* extends, i.e., the direction of the conveyance of the print paper P.

A movement unit that moves the sensor attachment component 23 and the guide component 23*a* in the direction of the conveyance of the print paper P is configured by the slide guide components 24*a* and 24*b*, the depression portion 24*c*, the motor 25, and the drive belt 26.

In addition, a photo sensor 27 is installed, as a detection unit that detects the passing of the print paper P, in a close proximity to the conveyance path whereupon the humidity detection sensor 11 is positioned, with an interval provided between the photo sensor 27 and the print paper P, and upon a side opposite the slide guide component 24*a* and 24*b*, such as is depicted in FIG. 22 (*b*). When the print paper P is conveyed close to the slide guide components 24*a* and 24*b*, and the photo sensor 27 detects the print paper P thereupon, the motor 25 rotates at a number of revolutions that corresponds to the speed of the movement of the print paper P, the drive belt 26 is driven in response the rotation of the motor 25 thereupon, and the shaft 21, whereupon the humidity detection sensor 11 is mounted, is moved in a line with the depression portion 24*c*, in the direction of the conveyance of the print paper P, at a speed equal to the speed of the conveyance of the print paper P.

It is to be understood that it would be permissible for the detection unit that detects the traversal of the print paper P to be a device other than the photo sensor 27, such as a switch that operates in a mechanical manner, provided that the device that is used as the detection unit is capable of detecting the print paper P.

The sensor attachment component 23, whereupon the humidity detection sensor 11 is bonded, thus moves vertically in accordance with the behavior of the print paper P, consistently maintaining, as a result, the constant distance between the obverse surface Pf of the print paper P and the sensor portion 11*a*, and the humidity detection sensor 11 moves at a movement speed that corresponds to the speed of movement of the print paper P, such that a sufficient amount of time that is required for detecting the moisture content of the print paper P may be assured, even in a circumstance wherein the speed of movement of the print paper P is a fast speed.

According to the fourth embodiment, when a configuration portion for an installation of the sensor portion 11*a* is installed upon a portion whereupon the print paper P traverses, it is possible that the sensor portion 11*a* either makes contact with or collides with the print paper P at the configuration portion for the installation of the sensor portion 11*a*, depending upon the behavior of the print paper P, thereby potentially interfering with the movement of the print paper P, and thus, the configuration described herein is modified so as not to interfere with the movement of the print paper P.

Fifth Embodiment

Figure 23:
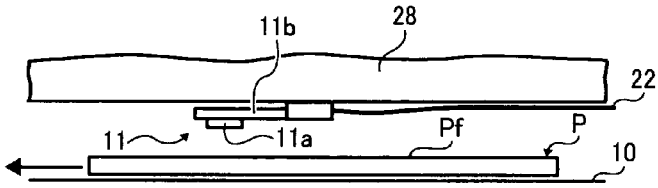
FIG. 23 is a diagram depicting an installation structure of a humidity detection sensor according to a fifth embodiment of the present invention.

In a circumstance wherein practically no behavior of the vertical movement of the print paper P that is conveyed upon the conveyance path 10 arises, then it would be permissible, such as is depicted in FIG. 23, to cause the humidity detection sensor 11 to be bonded upon a back side of a sensor attachment component 28, having a thin sheet shape, which is installed upon an upper portion of the conveyance path 10 whereupon the print paper P is conveyed, i.e., a side facing the conveyance path 10, and to protrude toward the obverse surface Pf of the print paper P. In addition, in such a circumstance, a distance of between the sensor attachment component 28 and the conveyance path 10 is adjusted such that the distance between the sensor portion 11*a* of the humidity detection sensor 11 and the obverse surface Pf of the print paper P is greater than or equal to 0.1 mm and less than or equal to 2 mm.

According to a fifth embodiment, the movement of the moisture content that arises from the print paper P is a variation in a direction of the flow of the water vapor and of the quantity of the water vapor. As a consequence, the variation in the flow arises from the installation of the sensor portion 11*a*, and in order to prevent being unable to ascertain the quantity of the variation of the moisture content, a shape and structure has been imparted to the sensor portion 11*a* that does not interfere with the normal movement of the moisture content.

In addition, the moisture content within the atmosphere evaporates from a surface of a liquid or a solid object, the humidity within the space that is close to the surface of the liquid or the solid object changes, and is thus capable of being distributed. Whereas the distribution may take any manner of state, depending on such as a shape, a temperature, the humidity, or a wind speed, of the surface of the liquid or the solid object, a range wherein the humidity changes significantly is typically presumed to be a narrow range of within 1 cm of the surface. A convection arises at a greater distance of up to 10 cm, and the water vapor that has evaporated mixes with the ambient atmosphere, achieving an approximately uniform distribution. The moisture content of the print paper P, having been appropriately regulated, is presumed to be between 4% and 6% when the print paper P comprises the A4 size. The moisture content quantity thereupon is thus a minuscule quantity, on the order of less than 1000 mg.

In addition, the moisture content that is discharged from the obverse surface Pf of the print paper P is also a minute quantity, and, as a consequence, when detecting the minute quantity of the moisture content thereupon, the minute quantity of the moisture content is more capable of adapting to the environment in the location surrounding the moisture content the further the distance from the print paper P, making it increasingly difficult to distinguish the minute quantity of the moisture content from the ambient environment. As a consequence, installing the humidity detection sensor 11 conventionally in a location wherein the distance with regard to the print paper P is not defined, such as in a periphery of the apparatus or in a close proximity to the print paper tray 9, complicates detecting the moisture content that arises from the print paper P. Accordingly, the distance of the sensor portion 11*a* with respect to the print paper P is regulated, and a modification of the detection of the moisture content is also performed.

Sixth Embodiment

In a circumstance wherein the plurality of the print paper P traverses the conveyance path 10 in a series, such as supplying the print paper P in a series to perform a series of print jobs, i.e., a series of image formations, the environment within the image forming apparatus changes according to the moisture content quantity of the print paper P. Thus, according to a sixth embodiment, when the print paper P does not traverse the location that is in opposition to the humidity detection sensor 11, the environmental control condition within the image forming apparatus is determined according to the value that is obtained by the detection of the humidity by the humidity detection sensor 11.

Figure 24:
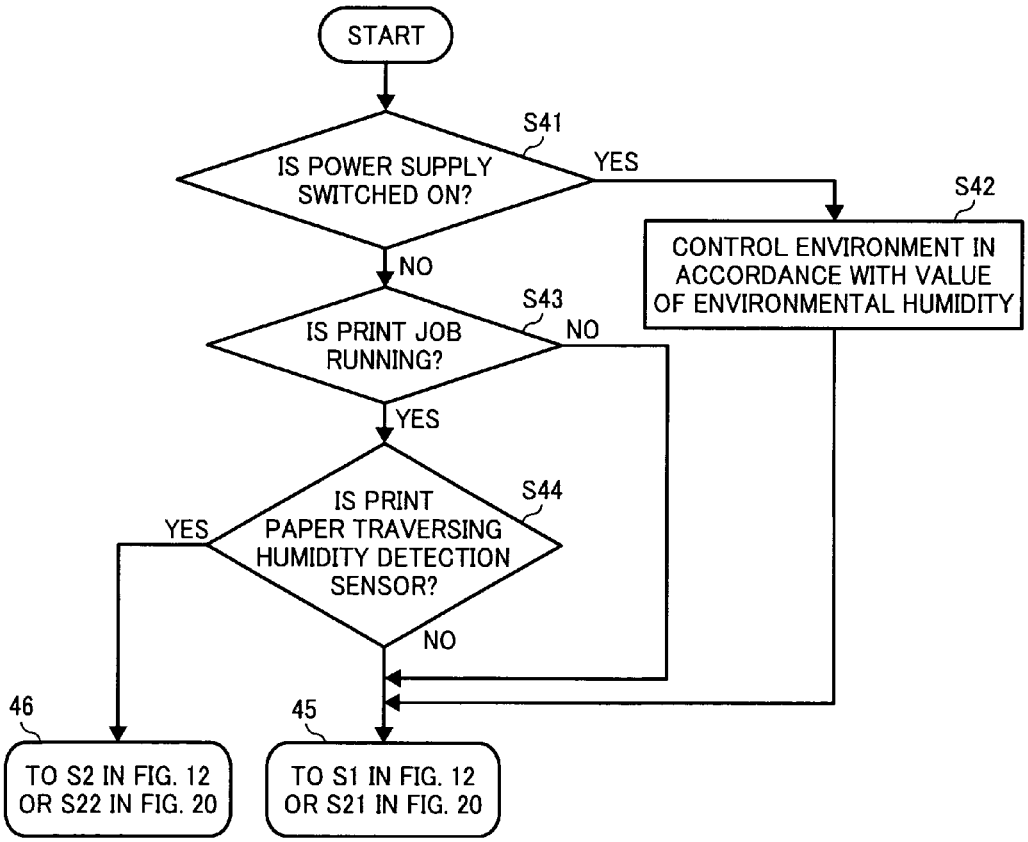
FIG. 24 is a flowchart describing a transfer control according to a sixth embodiment of the present invention.

Following is a description of the control according to the sixth embodiment, with reference to the flowchart that is depicted in FIG. 24.

The process commences with step S41, wherein a determination is performed as to whether or not a power supply of the image forming apparatus is switched from off to on. When the power supply is switched from off to on, the determination in step S41 is "YES," and the process proceeds to step S42. In step S42, the value of the environmental humidity when the power supply is switched from off to on is acquired. Thereafter, also in step S42, the value of the environmental humidity thus acquired is employed to perform the environmental control.

Put another way, in the control device ST depicted in FIG. 2, the measuring portion 13 acquires the value of the environmental humidity within the apparatus in accordance with the sensor output from the humidity detection sensor 11. In addition, the CPU 15 controls the environmental control portion 30, and controls a fan motor (not shown) that causes the fan (not shown) that is installed within the apparatus to rotate, in accordance with the value of the environmental humidity that is outputted from the measuring portion 13.

The environment within the apparatus is thus controlled by an air current that is caused by the fan (not shown) that revolves at the prescribed number of revolutions. Thereafter, the process proceeds to step S45, wherein the acquisition of the value of the environmental humidity according to either step S1 in the flowchart depicted in FIG. 12 or step S21 in the flowchart depicted in FIG. 20 is performed. Thereafter, a process is executed that is similar to the subsequent steps in either the flowchart depicted in FIG. 12 or the flowchart depicted in FIG. 20.

Next, if the power supply has been maintained in a powered on state, rather than having been switched from off to on, the determination in step S41 is "NO," and in step S43, a determination is made as to whether or not a printing operation, i.e., the image forming operation, has commenced. If the printing operation has commenced, the determination in step S43 is "YES," whereupon, in step S44, a determination is made as to whether or not the print paper P is traversing the location that is in opposition to the humidity detection sensor 11. If, in step S43, the printing operation has not commenced, the determination is "NO," and the process proceeds to step S45.

If, in step S44, the print paper P is traversing the location that is in opposition to the humidity detection sensor 11, the determination thereupon is "YES," whereupon the process proceeds to step S46, wherein the process, i.e., the acquisition of the value of the humidity that is detected upon the print paper, according to either step S2 in the flowchart depicted in FIG. 12 or step S22 in the flowchart depicted in FIG. 20 is performed, and thereafter, the process is executed that is similar to the subsequent steps in either the flowchart depicted in FIG. 12 or the flowchart depicted in FIG. 20.

In addition, if, in step S44, the print paper P is not traversing the location that is in opposition to the humidity detection sensor 11, the determination thereupon is "NO," whereupon the process proceeds to either step S1 in the flowchart depicted in FIG. 12 or step S21 in the flowchart depicted in FIG. 20.

Put another way, when the power supply is switched from off to on, and, in step S42, the environmental control is performed in accordance with the value of the environmental humidity, the process beginning with either step S1 in the flowchart depicted in FIG. 12 or step S21 in the flowchart depicted in FIG. 20 is executed, and the power supply has been maintained in the powered on state, rather than having been switched from off to on, whereas if the printing operation has not commenced or the print paper P is not traversing the sensor portion 11*a* of the humidity detection sensor 11, then the process beginning with either step S1 depicted in FIG. 12 or step S21 depicted in FIG. 20 is similarly executed, while, if the print paper P is traversing the sensor portion 11*a* of the humidity detection sensor 11, then the process beginning with either step S2 depicted in FIG. 12 or step S22 depicted in FIG. 20 is executed.

It is to be understood that the determination of the traversal of the print paper P by the location that is in opposition to the humidity detection sensor 11 is performed by installing a switch that turns on or off when the print paper P traverses the location that is in opposition to the humidity detection sensor 11, as an instance thereof. In addition, it would not be necessary to detect the environmental humidity at every instance of the traversal of the print paper P, and it would instead be permissible to regulate a quantity of sheets to be printed in a series, and to detect the environmental humidity at an instance of the traversal of the print paper P following the printing of the quantity of sheets thus regulated.

Seventh Embodiment

Figure 25:
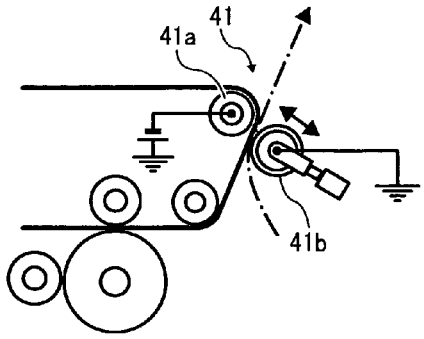
FIG. 25 is a partial enlargement of a secondary transfer device according to a seventh embodiment of the present invention.
Figure 26:
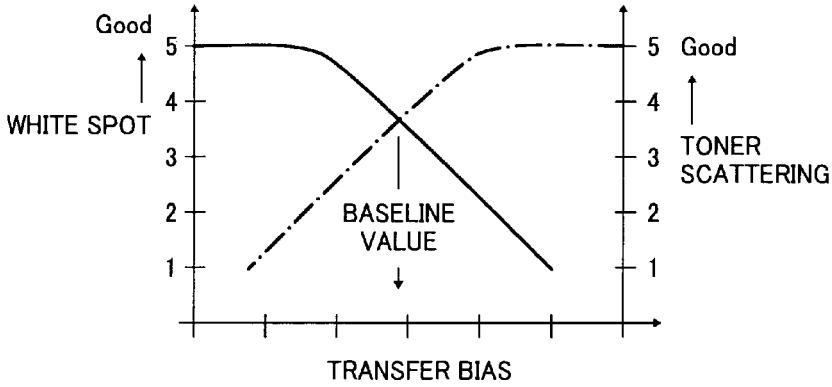
FIG. 26 is a graph depicting a relationship between a white spot image and a toner scattering image, which are anomalies that may arise when transferring the toner image to the print paper, and a transfer bias.
Figure 27:
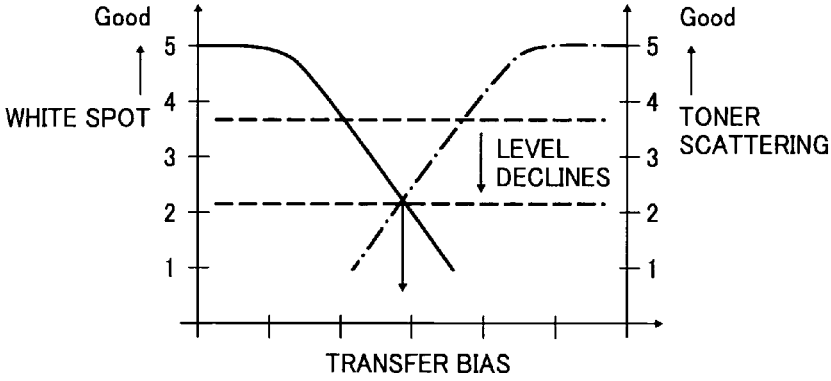
FIG. 27 is a graph depicting a relationship between the white spot image, the toner scattering image, and the transfer bias, when the print paper is in a low moisture content state.

According to a seventh embodiment, a configuration of the secondary transfer device 41 that is depicted in FIG. 25 differs from the configuration of the secondary transfer device 41 that is depicted in FIG. 14 according to the first embodiment. A remaining configuration according to the seventh embodiment is similar to the configuration according to the first embodiment, and thus, a description of a configuration element that is identical therebetween will be omitted hereinafter.

The transfer roller 41*b* of the secondary transfer device 41 is in opposition to the transfer roller 41*a*, including the electrode, and the transfer roller 41*b* is further attached to an adjustment mechanism. The adjustment mechanism performs a role of moving the transfer roller 41*b* closer to, or further away from, the transfer roller 41*a*, and is configured from either a spring or a solenoid, as an instance thereof. The solenoid would comprise a movable iron core within a coil, wherein the transfer roller 41*b* is supported by the movable iron core, the movable iron core is caused to be shuttle driven in a straight line by way of an electromagnetic force that arises by passing an electrical current through the coil, the transfer roller 41*b* is moved closer to, or further away from, the transfer roller 41*a*, according to the state of the moisture content of the print paper P, and the nip distance between the transfer roller 41*a* and the print paper P is altered thereby, as an instance thereof.

The CPU 15 controls the secondary transfer bias control portion 16 as described hereinafter, in accordance with the information of the moisture content of the print paper P that is derived by the process sequence according to either the first embodiment or the second embodiment.

When the moisture content quantity w of the print paper P is low, i.e., when the moisture content of the print paper P is 4% or less, as an instance thereof, the CPU 15 passes an electrical current through the solenoid in a direction that reduces the nip distance between the transfer roller 41*a* and the print paper P, and the transfer roller 41*b* is moved, by the current flowing through the solenoid, in a direction that approaches the transfer roller 41*a*. Thereafter, the transfer roller bias electric potential value, which is determined according to the memory table depicted in FIG. 13, is impressed upon the transfer roller 41*a*, including the electrode, the toner image is transferred upon the print paper P, and the print paper P whereupon the toner image has thus been transferred is conveyed toward the fixing device 8.

Thus, the transfer upon the print paper P, having the low moisture content, and therefore, the state of high resistance, is performed without applying the excess bias electric potential thereupon, and at the distance whereupon the print paper P approaches the transfer roller 41*a*, thereby transferring the toner image efficiently, and in a manner that impedes an abnormal electrical discharge from occurring thereby, upon the print paper P, thus preventing the occurrence of the white spot upon the toner image thus transferred.

In addition, the distance between the print paper P and the electrode of the transfer roller 41*a* is narrowed, thereby causing the toner image to be preserved upon the print paper P without a decline being incurred in a capability of the print paper P to preserve the toner image, thus allowing preventing the toner scattering from occurring as well.

As per the foregoing, according to the present invention, the degree of the transfer bias electric potential to be impressed upon the transfer roller and the degree of the bias electric potential to be impressed upon the print paper in order to preserve the toner solution upon the print paper is controlled according to the derived value of the moisture content quantity of the print paper, thus allowing obtaining a quality image by preventing the image defects from occurring. In particular, it is possible to perform the transfer upon the print paper, comprising the low moisture content, and therefore, the state of high resistance, without applying the excess bias electric potential thereupon, thereby transferring the toner image efficiently, and in a manner that impedes an abnormal electrical discharge from occurring thereby, upon the print paper, allowing preventing the white spot image defect thereupon.

Furthermore, applying the bias electric potential of the reverse polarity to the print paper subsequent to the transfer of the toner image upon the print paper preserves the toner image, without a decline being incurred in a capability of the print paper to preserve the toner image, thus allowing preventing the toner scattering from occurring as well.

Deriving the moisture content quantity of the print paper from the time taken by the print paper to traverse the location that is in opposition to the humidity detection sensor and the quantity of the variation of the humidity that is detected by the humidity detection sensor within the time taken by the print paper to traverse the location thus specified allows accurately detecting the moisture content quantity of the print paper during conveyance in a short amount of time. Moreover, the degree to be impressed of the transfer bias electric potential and the degree to be impressed of the bias electric potential in order to preserve the toner solution upon the print paper is controlled according to the moisture content quantity of the print paper that is conveyed within the image forming apparatus on a per sheet of print paper basis, thereby allowing obtaining an effect, on a per sheet of conveyed print paper basis, that is similar to the effect of the invention disclosed according to claim 1.

As the degree to be impressed of the transfer bias electric potential of the transfer roller and the nip distance is controlled according to the derived value of the moisture content quantity of the print paper, it is possible, in particular, to perform the transfer upon the print paper, comprising the low moisture content, and therefore, the state of the high resistance, without applying the excess bias electric potential thereupon, and by bringing the print paper into a close contact therewith, thereby transferring the toner image efficiently, and in a manner that impedes an abnormal electrical discharge from occurring thereby, upon the print paper, allowing preventing the white spot image defect thereupon.

Furthermore, the distance between the electrode of the transfer roller and the print paper narrows, thereby preserving the toner image, without a decline being incurred in a capability of the print paper to preserve the toner image, thus allowing preventing the toner scattering from occurring as well.

Deriving the moisture content quantity of the print paper from the time taken by the print paper to traverse the location that is in opposition to the humidity detection sensor and the quantity of the variation of the humidity that is obtained by detecting the humidity by the humidity detection sensor within the time taken by the print paper to traverse the location thus specified allows accurately detecting the moisture content quantity of the print paper during the conveyance of the print paper in a short amount of time. Moreover, the degree to be impressed of the transfer bias electric potential and the nip distance is controlled according to the moisture content quantity of the print paper that is conveyed within the image forming apparatus on a per sheet of print paper basis, thereby allowing obtaining an effect, on a per sheet of conveyed print paper basis, that is similar to the effect of the invention disclosed according to claim 3.

The humidity detection sensor includes a retention unit for retaining the humidity detection sensor, at a distance approaching the obverse surface of the print paper, such that the distance between the humidity detection sensor and the obverse surface of the print paper being conveyed is maintained at a constant value, thereby allowing the moisture content quantity of the print paper to be accurately detected.

The humidity detection sensor is moved at a speed that corresponds to the speed of the conveyance of the print paper, thereby allowing the moisture content quantity of the print paper to be detected with even greater accuracy.

The sensor portion of the humidity detection sensor is caused to protrude so as to make contact with the obverse surface of the print paper, thereby allowing the moisture content quantity of the print paper to be accurately detected.

The distance between the sensor portion of the humidity detection sensor and the obverse surface of the print paper is greater than or equal to 0.1 mm and less than or equal to 2 mm, allowing the moisture content quantity of the print paper to be detected with greater accuracy.

Ascertaining the environment within the image forming apparatus from the value of the humidity that is obtained by the detection of the humidity by the humidity detection sensor during the interval from the traversal of a sheet of print paper in a series of print jobs by the humidity detection sensor to the time that the next sheet of print paper in the series traverses the humidity detection sensor, as well as when the print paper does not traverse the location that is in opposition to the humidity detection sensor, such as when the power supply of the image forming apparatus is switched from on to off, allows maintaining an optimal image forming control state within the image forming apparatus by controlling the environment within the image forming apparatus according to the value of the humidity thus obtained.

Although the preferred embodiments of the present invention have been described, it should be understood that the present invention is not limited to these embodiments, and various modifications and changes can be made to the embodiments.

What is claimed is:

1. An image forming apparatus configured to convey a print paper toward a fixing device and to transfer a toner image formed upon an image forming body onto the print paper via a transfer roller having an electrode configured to apply a bias electric potential upon the print paper, the image forming apparatus comprising:

a humidity detection sensor configured to be disposed close to and face a surface of the print paper and detect a humidity of the print paper;

a retention electrode configured to be installed further downstream than the transfer roller along a direction of the conveyance of the print paper and further upstream than the fixing device along the direction of the conveyance of the print paper, and to preserve the toner image transferred to the print paper by applying a bias electric potential upon the print paper upon a surface that is upon an opposite side of the print paper to the surface of the print paper facing the transfer roller; and a control device configured to measure a moisture content quantity of the print paper based on an interval from a commencement of a variation in the humidity that is obtained by the humidity detection sensor to a maximum quantity of variation of the humidity, and control the bias electric potential of each of the electrode of the transfer roller and the retention electrode according to the moisture content quantity thus measured.

2. The image forming apparatus according to claim 1, wherein the control device includes a measuring portion configured to obtain a moisture content quantity of the print paper from a time whereat the print paper traverses a location configured to be in opposition to the humidity detection sensor and a quantity of a variation in a humidity that is obtained by the humidity detection sensor during the time whereat the print paper traverses thereupon.

3. The image forming apparatus according to claim 1, further comprising a retention unit, the retention unit located in the conveyance path of the print paper and configured to support the humidity detection sensor so that a constant distance is maintained between an obverse surface of the print paper being conveyed and a sensor portion of the humidity detection sensors.

4. The image forming apparatus according to claim 1, further comprising a retention unit configured to support the humidity detection sensor upon the conveyance path of the print paper, such that a constant distance is maintained, at a location whereupon the humidity detection sensor comes into close to an obverse surface of the print paper, between an obverse surface of a print paper being conveyed and a sensor portion of the humidity detection sensor; and a movement unit configured to move the retention unit in a unified manner with the humidity detection sensor, in a direction of a conveyance of the print paper, and at a speed corresponding to a speed of a conveyance of the print paper.

5. The image forming apparatus according to claim 1, wherein:

a sensor portion of the humidity detection sensor protrudes and is configured to contact an obverse surface of the print paper.

6. The image forming apparatus according to claim 5, wherein:

a distance between the sensor portion of the humidity detection sensor and the obverse surface of the print paper is configured to be greater than or equal to 0.1 mm and less than or equal to 2 mm.

7. The image forming apparatus according to claim 1, wherein the control device is configured to determine an environmental control condition within the image forming apparatus according to the value of the humidity that is obtained by the detection of the humidity by the humidity detection sensor, when the print paper is not traversing the location that is in opposition to the humidity detection sensor.

* * * * *